US008869656B2

(12) United States Patent
Desmond et al.

(10) Patent No.: US 8,869,656 B2
(45) Date of Patent: Oct. 28, 2014

(54) SCREWDRIVER TOOL WITH IMPROVED CORNER FIT FUNCTION

(75) Inventors: Michael R. Desmond, Cold Spring, KY (US); William H. Hoffman, Cincinnati, OH (US)

(73) Assignee: Senco Brands, Inc., Cincinnati, OH (US)

( * ) Notice: Subject to any disclaimer, the term of this patent is extended or adjusted under 35 U.S.C. 154(b) by 426 days.

(21) Appl. No.: 13/288,982

(22) Filed: Nov. 4, 2011

(65) Prior Publication Data

US 2013/0112051 A1 May 9, 2013

(51) Int. Cl.

| | |
|---|---|
| ***B25B 23/02*** | (2006.01) |
| ***B25B 17/02*** | (2006.01) |
| ***B25B 23/04*** | (2006.01) |
| *B25B 21/00* | (2006.01) |

(52) U.S. Cl.

CPC ..... *B25B 23/045* (2013.01); *B25B 21/00* (2013.01)

USPC ..... 81/57.37; 81/57

(58) Field of Classification Search

CPC ..... B25B 23/045; B25B 23/10; B25B 23/04; B25B 23/06; B23P 19/006

USPC ..... 81/57.3, 57.37, 57.44, 434, 435; 173/11, 176, 178

See application file for complete search history.

(56) References Cited

U.S. PATENT DOCUMENTS

| | | | | |
|---|---|---|---|---|
| 6,328,746 | B1 | 12/2001 | Gambale | |
| 6,511,484 | B2 | 1/2003 | Torode | |
| 7,032,482 | B1 * | 4/2006 | Hoffman | 81/434 |
| 7,134,367 | B2 | 11/2006 | Gehring | |
| 7,406,899 | B2 | 8/2008 | Walker | |
| 7,413,029 | B2 * | 8/2008 | Seno | 173/176 |
| 7,493,839 | B2 | 2/2009 | Massari, Jr. | |
| 7,997,171 | B2 | 8/2011 | Massari, Jr. | |
| 2004/0093991 | A1 * | 5/2004 | Wojtynek | 81/57.3 |
| 2010/0179559 | A1 | 7/2010 | Walker | |
| 2011/0232430 | A1 | 9/2011 | Hale | |

OTHER PUBLICATIONS

International Search Report, PCT/US2012/062650, 12 pages (Jan. 15, 2013).

* cited by examiner

*Primary Examiner* — Robert Scruggs
(74) *Attorney, Agent, or Firm* — Frederick H. Gribbell

(57) ABSTRACT

An automatic fastener driving tool, or an attachment, has a narrow front-end profile so that it is capable of driving screws that are in hard-to-reach positions, such as corners or channel members. The slide body subassembly has an extending mechanism, so that the fastener drive elements extend farther away from the main body structure of the tool/attachment, while still providing a stable and rugged overall tool structure to drive larger screws. The "lick-out" dimension is increased without also increasing the length and width of the feed tube.

18 Claims, 27 Drawing Sheets

SCREWDRIVER TOOL WITH IMPROVED CORNER FIT FUNCTION

TECHNICAL FIELD

The technology disclosed herein relates generally to automatic screw driving equipment and is particularly directed to an automatic screw driving tool or an attachment of the type which has a narrow front-end profile so that it is capable of driving screws (or other rotatable fasteners) that are in hard-to-reach positions, such as corners or angled members. Embodiments are specifically disclosed as having an extending mechanism within an elongated slide body subassembly, so that the drive elements extend farther away from the main body structure of the tool/attachment, while still providing a stable and rugged overall tool structure to reliably drive screws. One embodiment uses a timing belt structure; another embodiment uses a gear train structure.

Another feature of the technology disclosed herein is an external depth of drive adjustment subassembly that is mounted external to the feed tube housing, yet has a simple adjustment that does not lose its setpoint easily. By placing the depth of drive mechanism outside of the interior areas of the feed tube, the slide body subassembly can be shortened while still maintaining an easily adjustable depth of drive capability.

A further feature of the technology disclosed herein is the use of a dovetail shape on certain surfaces of the slide body subassembly, which allows the slide body subassembly to be robustly mounted so that it is capable of operating with long fasteners while also having the nosepiece mounted in an extended position for use with those fasteners.

STATEMENT REGARDING FEDERALLY SPONSORED RESEARCH OR DEVELOPMENT

None.

BACKGROUND

Conventional automatic fastener driving tools that work with strips of collated fasteners typically have a movable slide body subassembly that can slide into an open internal area of a feed tube or feed housing. Unfortunately, the conventional automatic fastener driving tools typically have a problem fitting into relatively small areas so as to be able to drive a rotatable fastener into one of those small areas. Mainly this is because the feed tube housing is rather large in size, and as the slide body subassembly "collapses" into the feed tube, the narrower nosepiece becomes insignificant with respect to the size of the feed tube itself. In essence, the tool will not be able to fit into a small area, because the feed tube is larger, and that limitation will not allow the fastener to be driven while the tool is attempting to fit into that small area.

SUMMARY

Accordingly, it is an advantage to provide an automatic fastener driving tool or attachment that has an extending mechanism to increase the "lick-out" characteristic of the tool so it can fit into smaller areas for driving rotatable fasteners.

It is another advantage to provide an automatic fastener driving tool or attachment that includes a timing belt drive within its slide body subassembly, to increase the distance that the tool's drive bit can extend past the feed housing while maintaining a relatively small cross-sectional area of the slide body subassembly.

It is yet another advantage to provide an automatic fastener driving tool or attachment that includes a gear-driven sprocket within its slide body subassembly, to increase the distance that the tool's drive bit can extend while maintaining a relatively small cross-sectional area of the slide body subassembly.

It is still another advantage to provide an automatic fastener driving tool or attachment that has a slide body subassembly that moves along linear guides, in which the surfaces of the slide body subassembly are dovetailed to provide a stronger, more durable surface along the guide rails to support an extending mechanism within the slide body subassembly, thereby having an improved linear tracking capability.

It is a further advantage to provide an automatic fastener driving tool or attachment that has an external depth of drive adjustment mounted at the rear portion of the feed tube housing, to allow for an extended surface for the slide body subassembly to act against the linear guides of the feed tube.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, slide body subassembly for a rotatable fastener driving tool apparatus is provided, the slide body subassembly comprising: (a) a drive gear having a first axis of rotation, the drive gear having a first set of engagement extensions along one of its surfaces at a first position along the first axis of rotation, the drive gear having a set of ratchet teeth at a second position along the first axis of rotation; (b) a sprocket having a second axis of rotation that is substantially parallel to the first axis of rotation, and that is spaced-apart from the drive gear, the sprocket having a first plurality of spaced-apart protrusions along an outer curved surface at a third position along the second axis of rotation, the sprocket having a second set of engagement extensions at a fourth position along the second axis of rotation; (c) a drive belt that runs between the drive gear and the sprocket, the drive belt having a second plurality of spaced-apart protrusions along one of its surfaces, the second plurality of spaced-apart protrusions being in mechanical engagement with the first set of engagement extensions of the drive gear and being in mechanical engagement with the second set of engagement extensions of the sprocket, the drive belt being caused to move if the drive gear rotates, and the drive belt then causing the sprocket to rotate; and (d) a displacement action mechanism that causes the drive gear to rotate by way of the set of ratchet teeth; and a feed tube with at least one sliding surface, which allows the slide body subassembly to move with respect to the feed tube, which movement actuates the displacement action mechanism.

In accordance with another aspect, a slide body subassembly for a rotatable fastener driving tool apparatus, the slide body subassembly comprising: (a) a drive gear having a first axis of rotation, the drive gear having a first set of gear teeth along one of its surfaces at a first position along the first axis of rotation, the drive gear having a set of ratchet teeth at a second position along the first axis of rotation; (b) a sprocket having a second axis of rotation that is substantially parallel to the first axis of rotation, and that is spaced-apart from the drive gear, the sprocket having a plurality of spaced-apart protrusions along an outer curved surface at a third position along the second axis of rotation, the sprocket having a second set of gear teeth along one of its surfaces at a fourth position along the second axis of rotation; (c) at least one intermediate gear having at least one intermediate axis of rotation, the at least one intermediate gear having at least one third set of gear teeth that are in mechanical engagement with the first set of gear teeth of the drive gear and being in mechanical engagement with the second set of gear teeth of the sprocket, the at least one intermediate gear being caused to move if the drive gear rotates, and the at least one intermediate gear then causing the sprocket to rotate; (d) a displacement action mechanism that causes the drive gear to rotate by way of the set of ratchet teeth; and a feed tube with at least one sliding surface, which allows the slide body subassembly to move with respect to the feed tube, which movement actuates the displacement action mechanism.

In accordance with yet another aspect, a drive apparatus for a rotatable fastener driving tool is provided, which comprises: an extending mechanism that is actuated by relative movement, and that has an output member which creates an indexing motion; and an elongated feed tube having a first end and a second, opposite end along a longitudinal axis, the feed tube having an open volume therewithin, the first end being open and sized and shaped to receive the extending mechanism, the second end having an opening to receive a rotatable drive bit that extends through the open volume, the feed tube having a slidable surface, the drive bit having a distal end that, along the longitudinal axis, is located a distance P from the first end of the feed tube, the feed tube having a maximum outer width dimension W and a maximum outer height dimension H; wherein: (a) during operation, the extending mechanism is movable with respect to the feed tube, along the slidable surface of the feed tube, which is relative movement that actuates the extending mechanism; and (b) a ratio P/W is greater than or equal to 0.5.

In accordance with still another aspect, a drive apparatus for a rotatable fastener driving tool is provided, which comprises: an extending mechanism that is actuated by relative movement, and that has an output member which creates an indexing motion; and an elongated feed tube having a first end and a second, opposite end along a longitudinal axis, the feed tube having an open volume therewithin, the first end being open and sized and shaped to receive the extending mechanism, the second end having an opening to receive a rotatable drive bit that extends through the open volume, the feed tube having a slidable surface, the drive bit having a distal end that, along the longitudinal axis, is located a distance P from the first end of the feed tube, the feed tube having a maximum outer width dimension W and a maximum outer height dimension H; wherein: (a) during operation, the extending mechanism is movable with respect to the feed tube, along the slidable surface of the feed tube, which is relative movement that actuates the extending mechanism; and (b) a ratio P/H is greater than or equal to 0.5.

In accordance with a further aspect, a drive apparatus for a rotatable fastener driving tool is provided, which comprises: a slide body structure that is actuated by relative movement, and that has an output member which creates an indexing motion, the slide body structure having a dovetail shaped body member; and an elongated feed tube having a first end and a second, opposite end along a longitudinal axis, the feed tube having an open volume therewithin, the first end being open and sized and shaped to receive the slide body structure, the feed tube having an elongated slidable surface at an interior location, the slidable surface having a shape that corresponds to mate against the dovetail shaped body member, wherein during operation, the slide body structure is movable with respect to the feed tube along the slidable surface of the feed tube, which relative movement actuates the slide body structure.

In accordance with a yet further aspect, a drive apparatus for a rotatable fastener driving tool is provided, which comprises: a slide body subassembly that is actuated by relative movement, and that has an output member which creates an indexing motion; an elongated feed tube having a first end and a second, opposite end along a longitudinal axis, the feed tube having an open volume therewithin, the first end being substantially open and sized and shaped to receive the slide body subassembly, the feed tube having an elongated slidable surface and, during operation, the slide body subassembly is movable with respect to the feed tube, which relative movement actuates the slide body subassembly; an elongated nosepiece that is adjustably affixed to the slide body subassembly, the nosepiece having a third end and a fourth, opposite end along an axis of movement that is substantially parallel to the longitudinal axis, the third end extending past the first end of the feed tube so as to contact a surface of a workpiece, the fourth end extending toward the second end of the feed tube and having a first contact surface; and a depth of drive subassembly that is mounted proximal to the second end of the feed tube, the depth of drive subassembly including a movable member that has a second contact surface, the first contact surface of the fourth end of the nosepiece coming into mechanical communication with the second contact surface at the end of a fastener driving cycle.

In accordance with a still further aspect, a drive apparatus for a rotatable fastener driving tool is provided, which comprises: a slide body subassembly that is actuated by relative movement, and that has an output member which creates an indexing motion; an elongated feed tube having a first end and a second, opposite end along a longitudinal axis, the feed tube having an open volume therewithin, the first end being substantially open and sized and shaped to receive the slide body subassembly, the feed tube having an elongated slidable surface and, during operation, the slide body subassembly is movable with respect to the feed tube, which relative movement actuates the slide body subassembly; an elongated nosepiece that is adjustably affixed to the slide body subassembly, the nosepiece having a third end and a fourth end at opposite positions along an axis of movement that is substantially parallel to the longitudinal axis, the third end extending past the first end of the feed tube so as to contact a surface of a workpiece, the fourth end extending toward the second end of the feed tube; and a depth of drive subassembly that is mounted at an external location with respect to the feed tube, the depth of drive subassembly having an adjustable mechanism that engages with the fourth end of the nosepiece.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

FIG. 26 shows two views of a prior art automatic screwdriver tool, shown in its unactuated state.

FIG. 27 shows two views of a prior art automatic screwdriver tool, shown in its actuated state.

DETAILED DESCRIPTION

Figure 1:
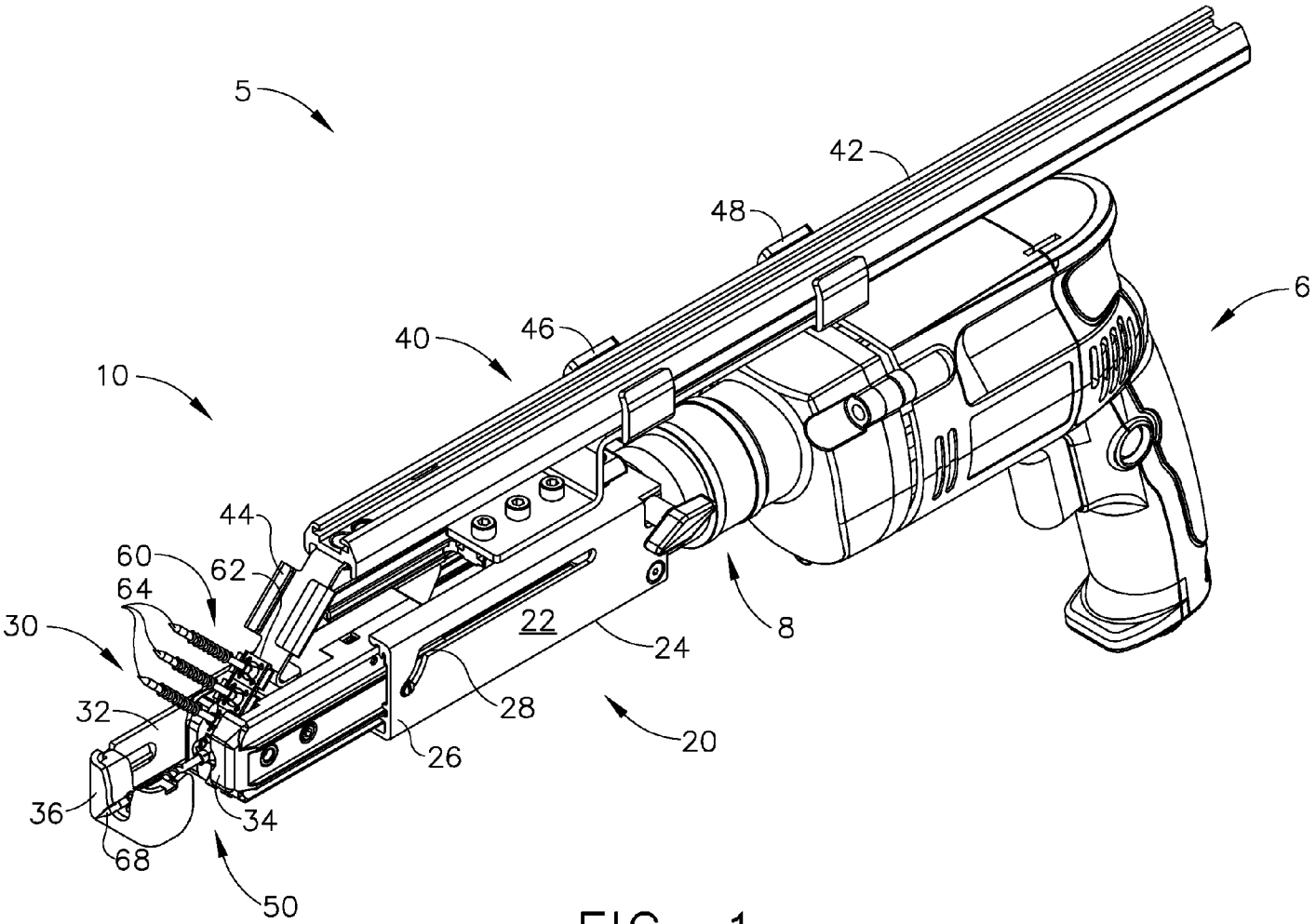
FIG. 1 is a perspective view of a full assembly of the attachment tool technology disclosed herein as it is mounted to a conventional screwdriver gun.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to the drawings, FIG. 1 shows a hand-held fastener driving tool combination, generally designated by the reference numeral 5. In this embodiment, there is an attachment assembly 10 (the "attachment," or sometimes referred to as the "tool" or the "attachment tool"), a separate screw gun 6, and an adapter 8. This type of separate screw gun 6 is available from many different manufacturers, including Senco Products, Inc. and DeWalt. The screw gun 6 has an output bit (not visible in this view) that can drive the head of a screw or other type of rotatable fastener.

The attachment 10 mates to the front end of the screw gun 6 by use of a separate adapter 8. Once the attachment 10 has been mounted to the screw gun 6, a collated strip of screws can be used with the screw gun 6, via this attachment 10. Attachment assembly 10 includes a housing portion 20, a front end portion 30, a feed rail portion 40, and a screw feed portion 50. Fastener driving tool 10 is designed for use with a flexible strip of collated screws, and the flexible collated screw strip subassembly is generally designated by the reference numeral 60.

The housing portion 20 of the tool includes a front "feed housing" outer shell structure 22, and bottom gripping surface 24. Housing portion 20 is also sometimes referred to herein as an "elongated housing." Toward the front of housing portion 20 is an elongated "feed tube" 26, which houses certain movable portions of the tool 10, as discussed below. In the illustrated embodiment, the feed tube 26 is fixedly attached to the housing portion 20, and is also sometimes referred to herein as a "first member." It will be understood that feed tube 26 can be of any desirable cross-sectional shape while performing its functions (e.g., rectangular, square), and that it is substantially square in cross-section in the illustrated embodiments. The feed tube 26 has a longitudinal axis that runs between a substantially open front end and a substantially open rear end, which are at opposite ends of the feed tube; a drive bit 66 fits through the rear end of the feed tube, and is substantially parallel to the longitudinal axis. The feed tube 26 is mainly hollow, that is, it has an interior volume that is mostly empty space, to allow the slide body subassembly to move in and out of the front end of the feed tube.

The collated strip 60 subassembly slides through a feed rail 42 that is mounted onto pedestals 46 and 48 that are mounted to the upper surface of the housing 22. On the lower surface of the housing 22 is a grip area 24, for placement of the user's hand. Attachment 10 includes an innovative external depth of drive adjustment subassembly 80 (see FIG. 2), and typically will have a depth of drive indicator (not shown). The housing 22 thus exhibits a "mating end" near the adapter 8, which receives the front end of the screw gun 6.

The front end portion 30 includes a moveable nosepiece 32, which is attached to a slide body subassembly 34. Both the nosepiece 32 and slide body subassembly 34 are moveable in a longitudinal direction of the tool 10, and when the nosepiece 32 is pressed against a solid object, the fastener driving tool 10 will be actuated to physically drive one of the screws into the solid object, also referred to herein as the "workpiece." Nosepiece 32 has a front surface 36, which preferably has a rough texture such as sandpaper, so that it will not easily slide while pressed against the surface of the workpiece when the tool is to be utilized.

In the illustrated embodiment of FIG. 1, the nosepiece 32 is detachable from the slide body subassembly 34 so that the nosepiece can be re-positioned for different lengths of fasteners, and then re-attached. The nosepiece 32 has a plurality of screw length positioning holes 38 (see FIG. 2), which are used to attach nosepiece 32 to the slide body subassembly 34 at different relative positions to one another. The nosepiece is thus adjustably affixed (i.e., mounted) to the slide body subassembly. Slide body subassembly 34 is also sometimes referred to herein as a "second member," or an "elongated slide body." The nosepiece 32 also has a rear inclined edge 119, which works against another inclined surface 95 that is part of a depth of drive subassembly 80, which is described in greater detail below, in conjunction with the description of FIGS. 33-36. Nosepiece 32 is elongated, and has two opposite ends: a front end at 36 and a rear end at the inclined edge 119. As the tool is actuated (during a fastener driving event), nosepiece 32 has an axis of movement that is substantially parallel to the longitudinal axis of the feed tube 26.

The slide body subassembly 34 is movably "attached" to the feed tube 26, such that slide body subassembly 34 essentially slides along predetermined surfaces proximal to feed tube 26. In addition, an angled slot 28 is formed in feed tube 26 to provide a camming action surface (essentially a slotted opening having a curved portion and a straight portion) for a cam roller (or "cam follower") 70 (see FIG. 2) to traverse as the slide body subassembly 34 moves, relative to the feed tube 26. This action is used to cause the "next" fastener of the collated strip (see below) to index to a "firing position" (or "drive position"), by way of an indexing action of the slide body subassembly 34 (which indexing action is internal to the slide body subassembly).

Figure 30:
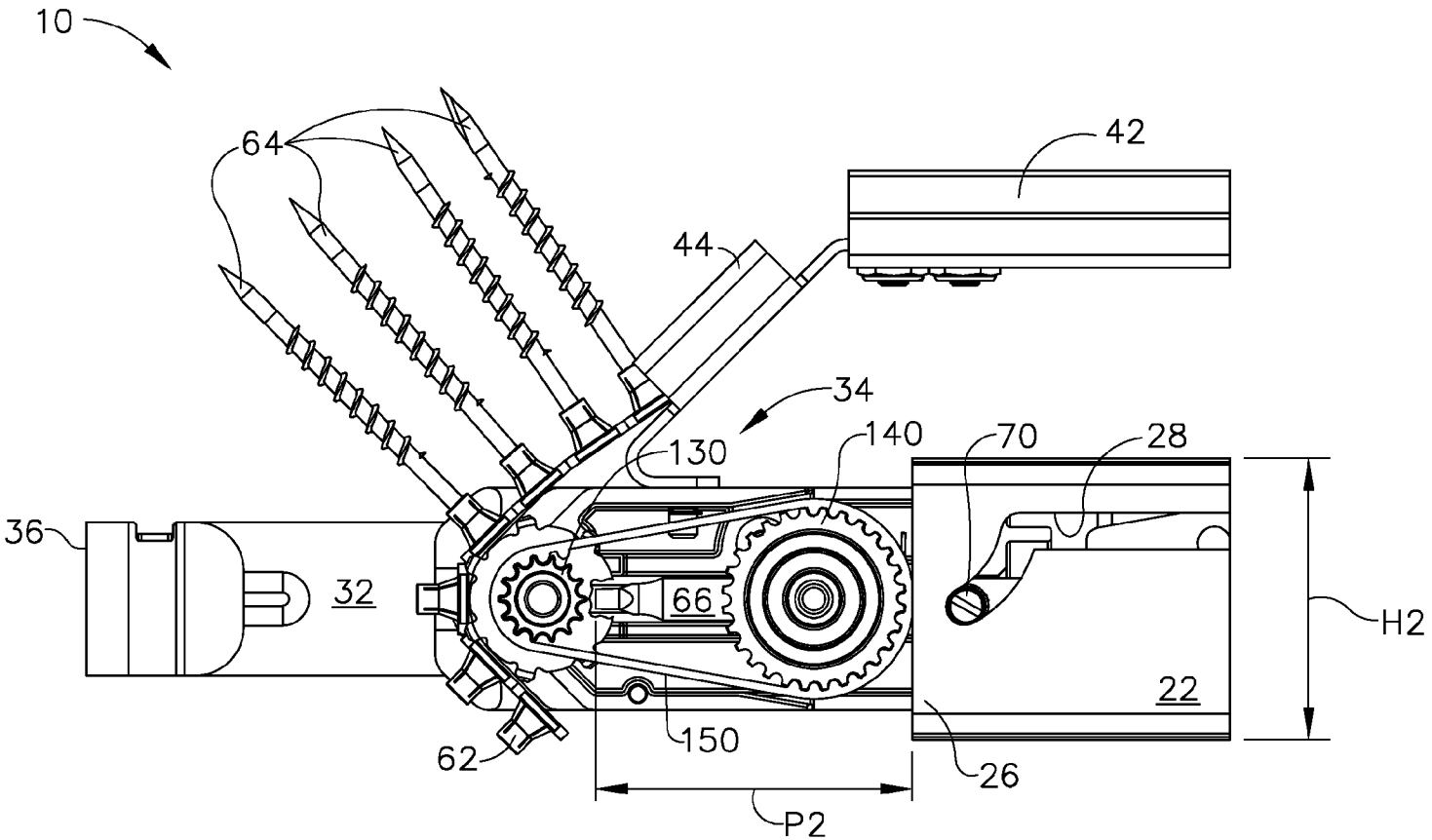
FIG. 30 is a side elevational view of a front portion of the tool of FIG. 2, showing details of the slide body subassembly with the slide body support removed, with the tool in its unactuated state.
Figure 31:
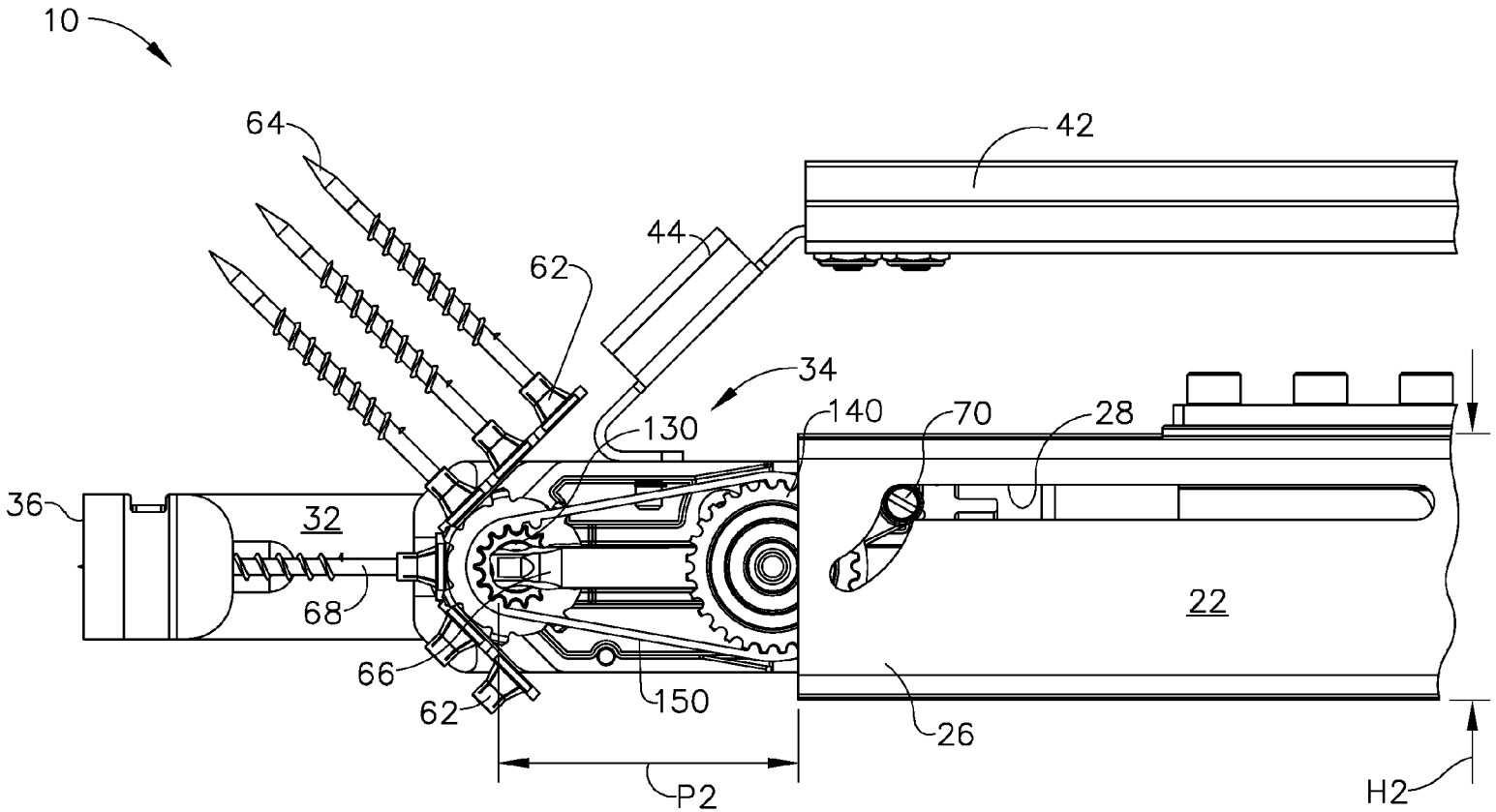
FIG. 31 is a side elevational view of a front portion of the tool of FIG. 2, showing details of the slide body subassembly with the slide body support removed, with the tool in a partially actuated state, such that the drive bit is about to engage the head of the fastener that is in the drive position.

The guide rail portion 40 includes a straight guide member 42, and an angled "front portion" guide member 44, that each can receive a flexible collated strip of fasteners, in this case the collated screw subassembly 60. The collated screw subassembly 60 mainly consists of a plastic strip 62 that has several openings to receive individual screws 64. The overall collated screw subassembly is flexible to a certain degree, as can be seen in FIGS. 30 and 31 by the curved orientation of the plastic strip 62 as it is fed through the slide body subassembly 34.

Some of the mechanical mechanisms described above for the portable fastener driving tool 10 have been available in the past from Senco Products, Inc. and Senco Brands, Inc., including such tools as the Senco Model Nos. DS162-14V and DS200-14V. These earlier tools utilized a fixed feed tube, a movable slide body, and nosepiece structure, without the "extended nose" feature of the technology disclosed herein. Some of the components used in the technology disclosed herein have been disclosed in commonly-assigned patents or patent applications, including a U.S. Pat. No. 5,988,026, titled SCREW FEED AND DRIVER FOR A SCREW DRIVING TOOL; a U.S. Pat. No. 7,032,482, titled TENSIONING DEVICE APPARATUS FOR A BOTTOM FEED SCREW DRIVING TOOL FOR USE WITH COLLATED SCREWS; and a U.S. Pat. No. 7,082,857, titled SLIDING RAIL CONTAINMENT DEVICE FOR FLEXIBLE COLLATED SCREWS USED WITH A TOP FEED SCREW DRIVING TOOL. These patent properties have been assigned to Senco Brands, Inc., and their disclosures are incorporated herein by reference in their entireties.

The main purpose of tool 10 is to drive rotatable fasteners (e.g., screws or bolts) that are provided in the form of the flexible collated strip subassembly 60. The individual screws 64 are held in place by a flexible plastic strip 62, and as the screws traverse through the guide members 42 and 44, they are ultimately directed toward the front end portion of the tool 30 until each of the screws 64 reaches the "drive" position at 68. When viewing the tool 10 at its front-most portion, the left-most screw 64 has been indexed to the drive position at 68 (see FIG. 31, for example), and thus is now essentially colinear with the main drive components of the tool 10. As the collated screw subassembly 60 is moved through the screw feed portion 50, the plastic strip 62 will eventually make contact with a sprocket 130 (see FIG. 2) that acts as a rotary indexer, and which is located inside the slide body subassembly 34. The sprocket moves each of the portions of the plastic strip 62 into a proper rotary position so that their attached screws 64 eventually end up in the front-most drive position 68. The sprocket is sometimes referred to herein as the "output member" of the slide body subassembly, which creates an indexing motion.

When the nosepiece 32 is actuated by being pressed against a workpiece, then a drive bit 66 will push the screw at 68 into the workpiece, and the drive bit 66 will also then be turned in a rotary motion to twist the screw at 68 in the normal manner for driving a screw 64 into a solid object. Once the screw at 68 has been successfully driven into the solid object, then the tool 10 is withdrawn from the surface of the solid object, and of course the screw 64 remains behind and has now broken free from the plastic strip 62 (see FIG. 21: the "lead screw" at 68 will break free from the plastic strip 62). In one mode of the technology disclosed herein, the tool 10 will now be free to allow the sprocket to perform its rotary indexing function and to bring forth the next screw 64 into the front-most drive position at 68. This type of screw-feed actuation can be referred to as "indexed on return," since the "lead screw" is moved into the "firing position" at 68 as the nosepiece 32 is released (or "returned") from the surface of the workpiece.

The tool 10 can also be configured in an alternative screw-feed actuation mode, in which the lead screw is moved into the firing position at 68 as the nosepiece 32 is pressed against the surface of a workpiece; this type of screw-feed actuation can be referred to as "indexed on advance." If tool 10 is configured for indexed on advance, then the lead screw would not yet be in the position at 68 at the moment the nosepiece 32 is "relaxed" or "free," in its non-firing state. Instead, the lead screw is not indexed into the firing position at 68 until the nosepiece 32 is "pushed in" (or "advanced") toward the main body portion of the tool 10 (e.g., toward the adaptor 8), which is discussed below in greater detail. Note that the indexed on advance configuration is a preferred mode of operation for tool 10. It will be understood that both the indexed on advance and indexed on return screw-feed actuation modes of operation can work with the technology disclosed herein.

Figure 2:
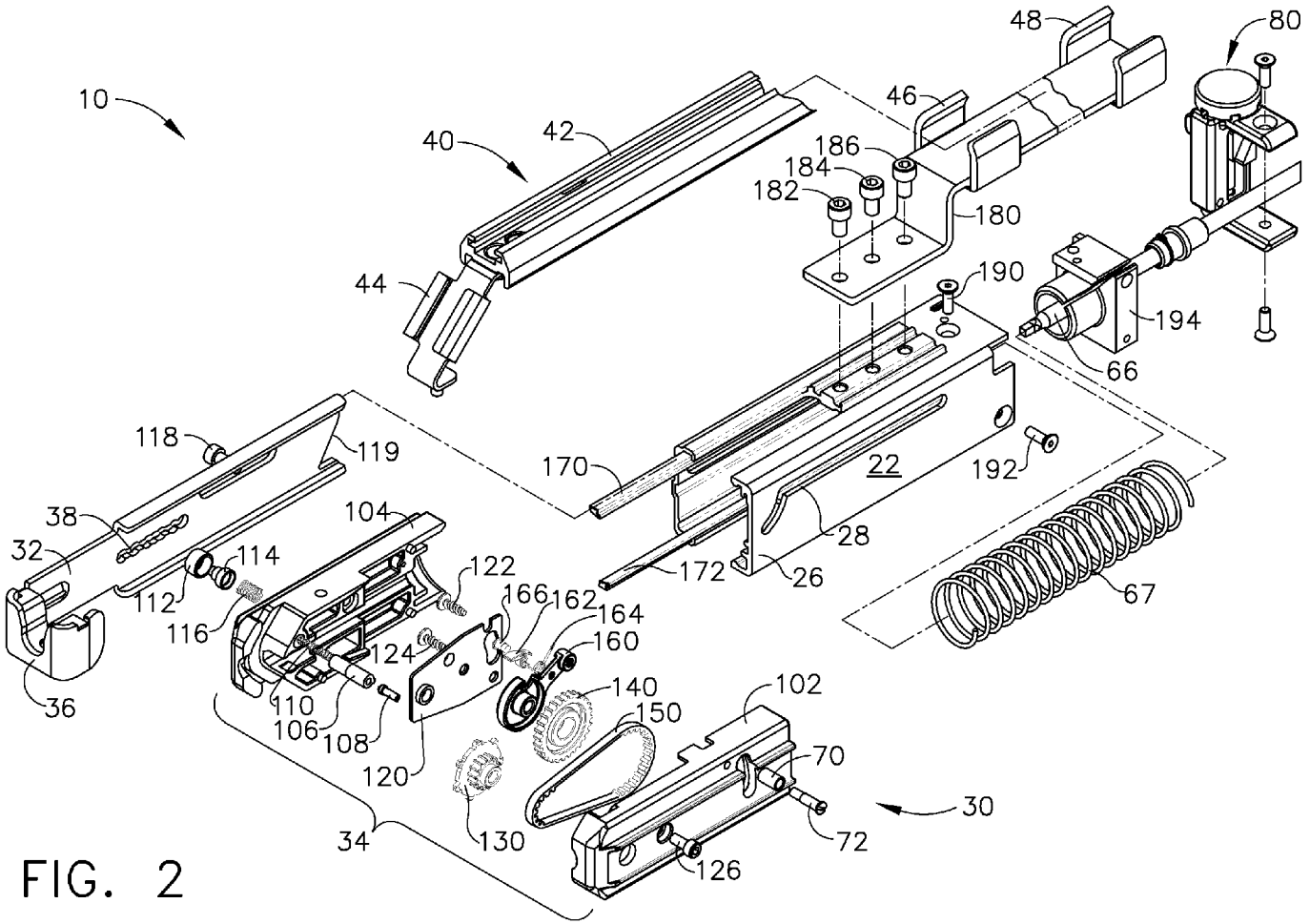
FIG. 2 is an exploded view in perspective of the assembly illustrated in FIG. 1.

Referring now to FIG. 2, many of the components of the tool 10 are illustrated in an exploded view, which allows most of the internal components of the slide body subassembly 34 to be viewed. A slide body cover 104 is mated to a slide body support 102, and these two rather large structures will contain the mechanical components that make the slide body subassembly operate. Assembled into the slide body cover is a detent pin 108, which travels through a detent housing 106, through a detent spring 110, into an opening of the cover 104. Detent pin 108 mates into an opening of a slide body subassembly plate 120.

There is a nosepiece adjustment subassembly that fits through one of the openings 38 in the nosepiece 32, and also is operatively connected to the slide body cover 104. This nosepiece adjustment subassembly is made up of a plunger 114, a cap 112, and a spring 116. A pair of fasteners 122 and 124 are used to hold the plate 120 in place with respect to the slide body cover 104. There is a stop member 118 that prevents the nosepiece 32 from extending past a certain point.

FIG. 2 also illustrates an "extending mechanism" that is positioned between the plate 120 and the slide body support 102. There are several major components in this extending mechanism, including a sprocket 130, a drive gear 140, a timing belt 150, and a feed pawl 160. There also is a detent finger 162, a torsion spring 164, and a locating pin 166, which operate with the drive feed pawl 160. The operations of these mechanisms will be described in greater detail, below.

The sprocket 130 is mounted between locating bushing holes on the slide body support and cover (102 and 104). The drive gear 140 is mounted to a bushing surface (or bearing surface) on the feed pawl 160, and is held in place between that and the slide body support 102, and a pilot hole in the plate 120. The drive feed pawl 160 is allowed to pivot within a slot of the plate 120 and the combination of a cam follower 70 and a cam screw 72, that fit within another slot in slide body support 102, holds the feed pawl in its proper orientation. The plate 120 is held in place with respect to the slide body support 102 by the fasteners 122, 124, and 126.

As noted above, the slide body subassembly 34 is movable within the "feed tube" 26 and "feed housing" 22. There are two linear guides 170 and 172 that are mounted within the feed housing 22, and the slide body subassembly 34 has specific surfaces that slide against the linear guides. This will be described in greater detail below. Linear guides 170 and 172 are preferably made of a very low friction material, such as TEFLON.

The drive bit 66 also fits through a main portion of the feed housing 22, through a spring post 194. The spring post 194 is attached to the feed housing 22 by two fasteners 190 and 192. A large coil spring 67 fits around the circular bearing surface of spring post 194, and presses against a rear surface of the slide body subassembly 34, thereby biasing the slide body subassembly toward the front of the tool (i.e., toward the nosepiece portion of the tool).

FIG. 2 also shows more details about the feed guide rail portion 40. The linear guide rail 42 is attached to brackets 46 and 48. Those brackets are positioned on a mounting rail 180, and that rail is affixed to the top portion of the feed housing 22 by fasteners 182, 184, and 186.

Figure 3:
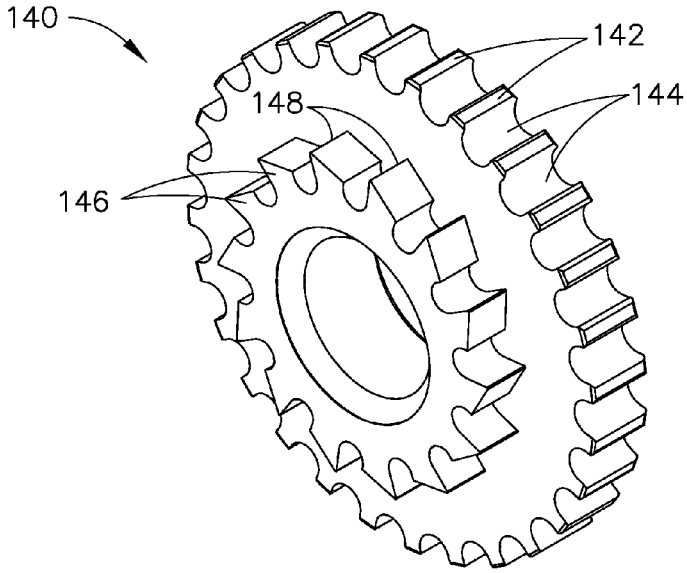
FIG. 3 is a perspective view of the drive gear of the tool of FIG. 2.
Figure 4:
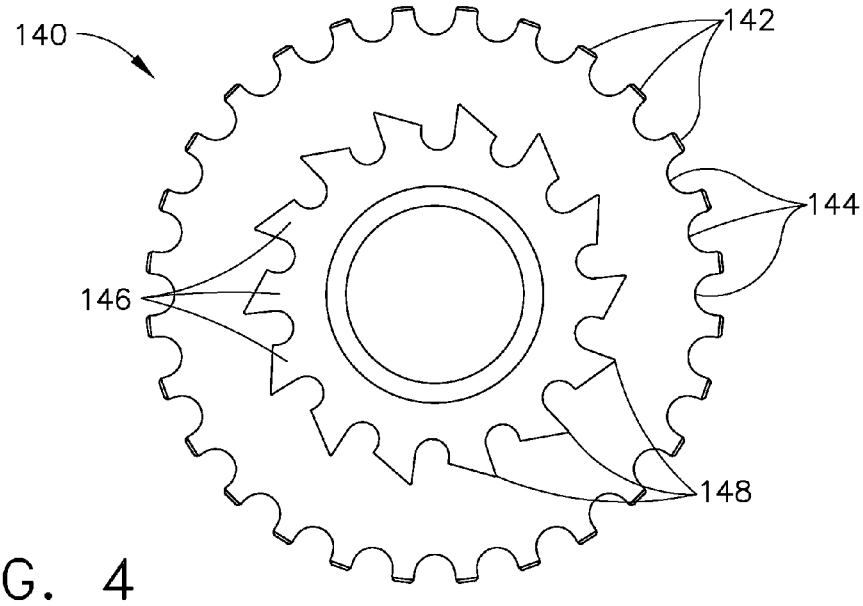
FIG. 4 is an elevational view of the drive gear of FIG. 3.

Referring now to FIGS. 3 and 4, the drive gear 140 is illustrated in some detail. The larger diameter portion of drive gear 140 includes a relatively circular profile, with multiple extensions at 142 and multiple depressions 144 that are spaced-apart therebetween. The depressions 144 are sized and shaped to receive "bumps" 152 on the timing belt 150, and thus this drive gear also acts as a timing gear.

The smaller diameter portion of drive gear 140 is also mainly circular in profile, but with multiple extensions 146. Each of these extensions has an uppermost edge 148, which is used for a function that will be explained below in greater detail. In general, the feed pawl has an attached detent finger that mates with these extensions 146 and 148, and acts as a ratchet.

Figure 5:
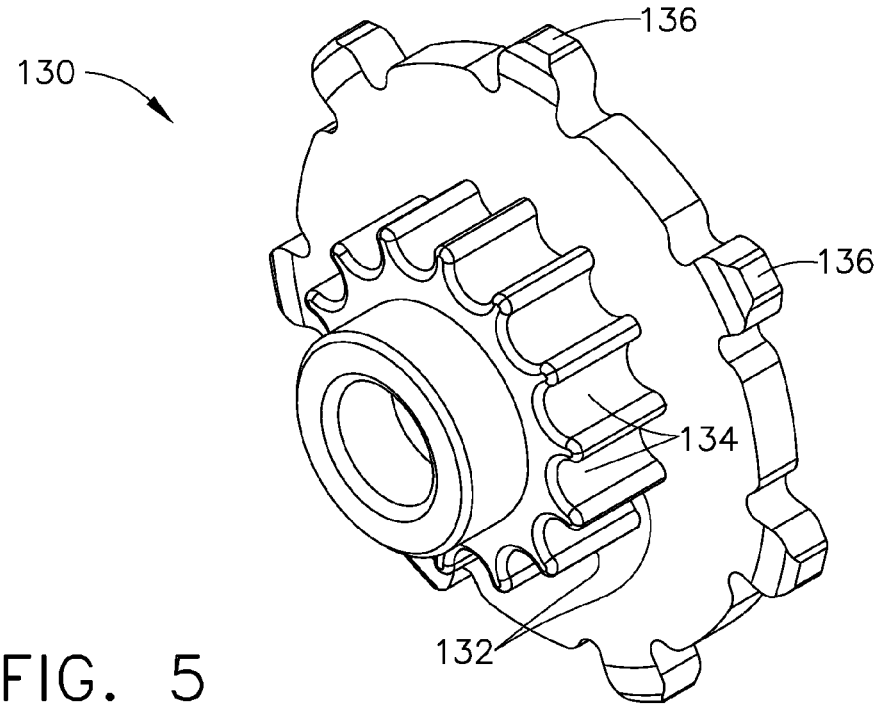
FIG. 5 is a perspective view of the sprocket of FIG. 2, showing the sprocket from the "gear side."
Figure 7:
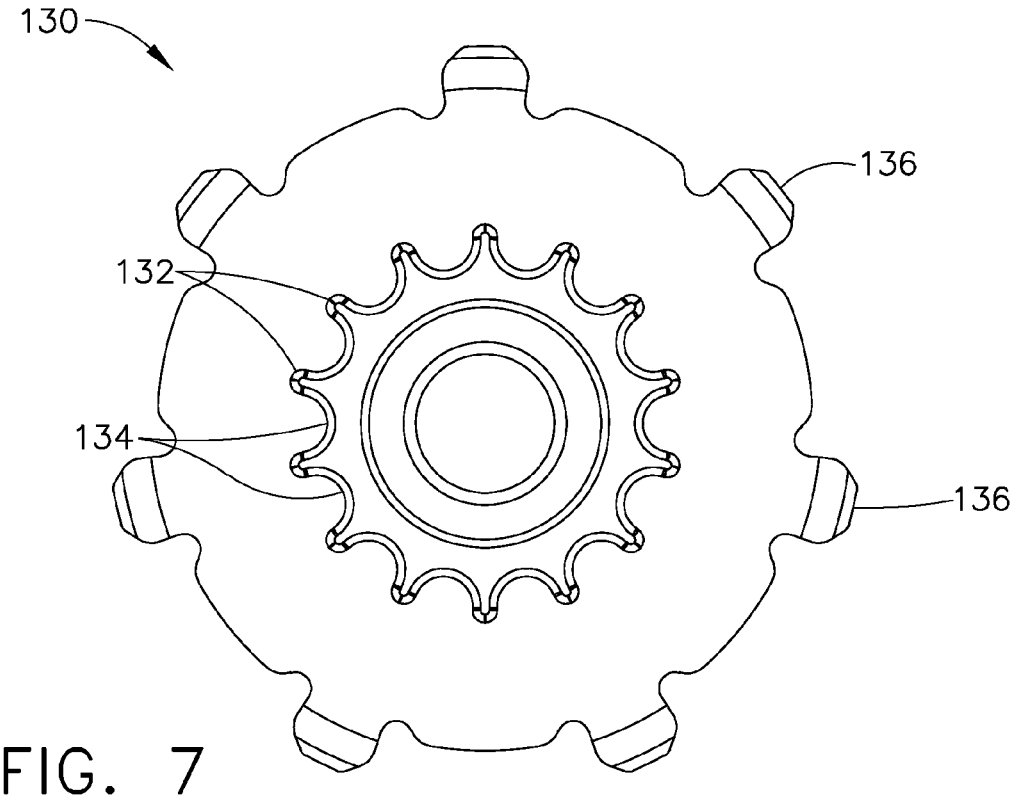
FIG. 7 is a side elevational view of the sprocket of FIG. 3, showing its "gear side."

Referring now to FIGS. 5 and 7, the sprocket 130 is illustrated, showing its timing belt side. The larger diameter portion of sprocket 130 includes several protrusions 136 that extend outward from an otherwise relatively circular diameter outer profile. These extensions 136 engage the openings in collated strip of fasteners, and acts as a primary mechanism for driving the strip of fasteners through the front end of the tool.

The smaller diameter portion of this side of the sprocket has a relatively circular profile with multiple extensions at 132 and multiple depressions at 134, which are spaced-apart there between. The depressions 134 are sized and shaped to engage the bumps in the timing belt 150.

Figure 6:
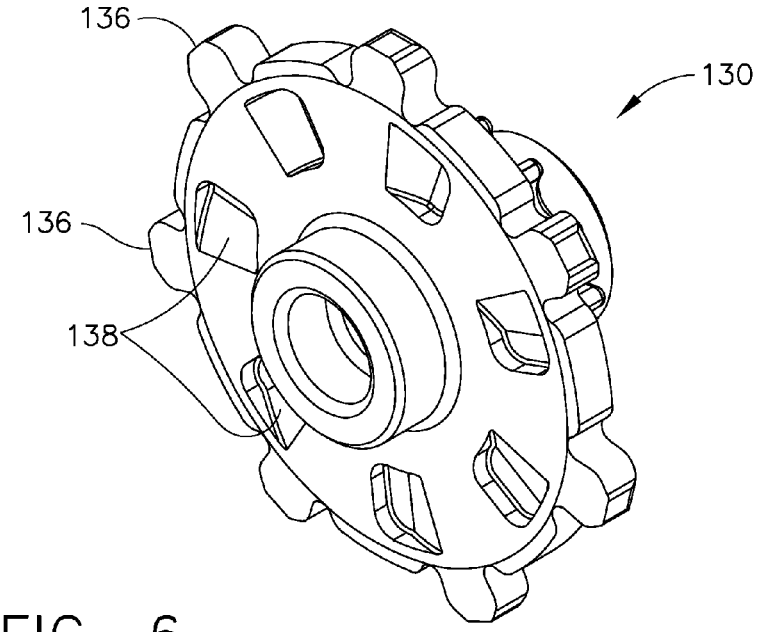
FIG. 6 is a perspective view of the sprocket of FIG. 3, showing the sprocket from the "detent side."
Figure 8:
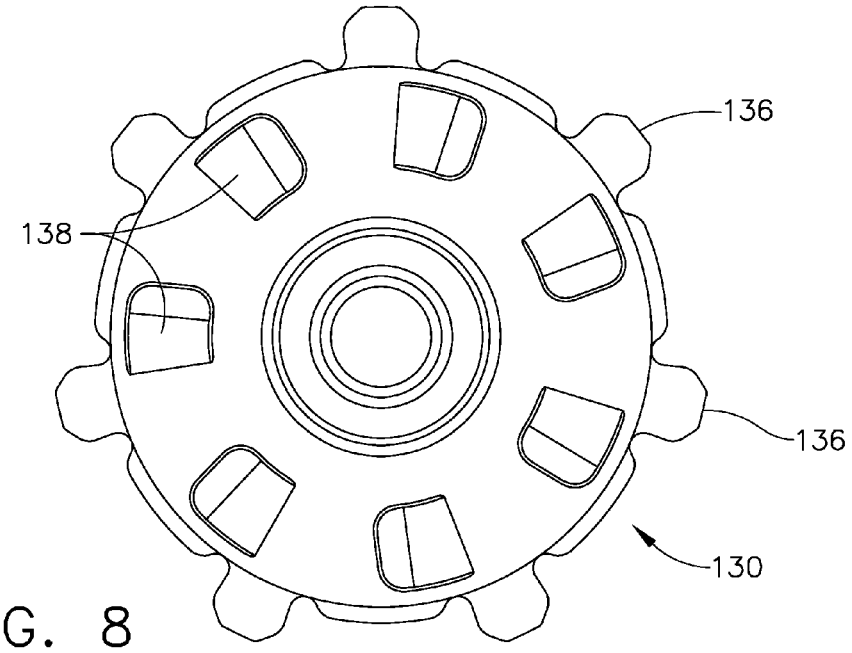
FIG. 8 is a side elevational view of the sprocket of FIG. 3, showing its "detent to side."

Referring now to FIGS. 6 and 8, the sprocket 130 is illustrated, showing its feed pawl side. The sprocket teeth 136 are again depicted, and the other major feature on the site of the sprocket are a series of spaced-apart depressions 138. These depressions are sized and shaped to engage the distal end of the detent pin 108. This action tends to hold the sprocket and collated strip grouping in their proper locations as the drive bit 66 pushes (drives) the fastener (typically a screw) from the collated strip as that fastener is driven into a workpiece.

Figure 10:
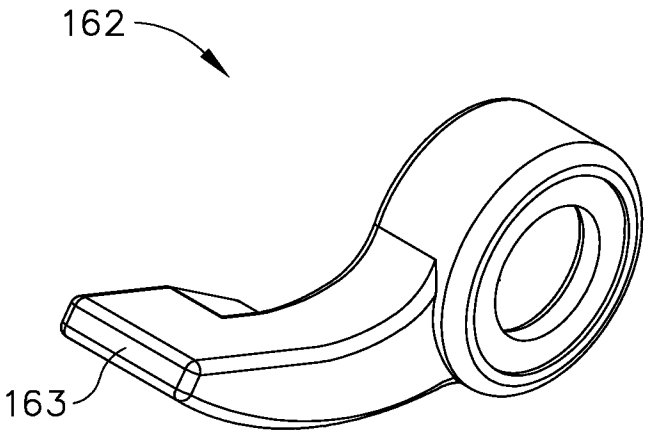
FIG. 10 is perspective view of the detent finger of FIG. 9.
Figure 9:
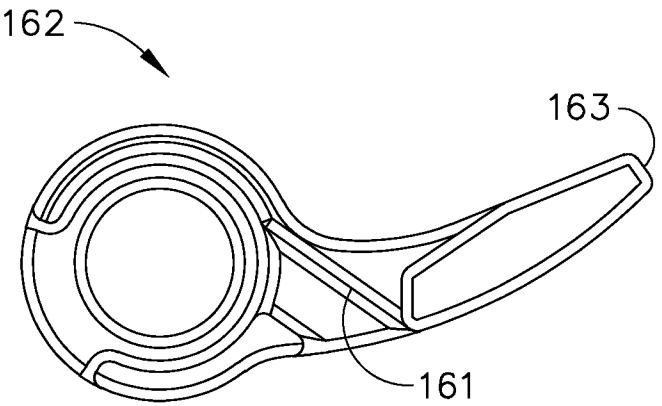
FIG. 9 is a side view of the detent finger used in the tool of FIG. 2.

Referring now to FIGS. 9 and 10, the detent finger 162 is illustrated. This pin has a circular portion with a circular opening that can rotate about the locating pin 166. Detent pin 162 also has an extension with a distal end 163. This distal end provides a contact surface and mechanically interfaces with an opening of the feed pawl 160. Detent pin 162 also contains a mechanical stop at 161 which holds the torsion spring 164 in place. These features will be illustrated in greater detail in FIG. 20. These components are used as a "displacement action mechanism," in that they are used to convert linear motion into rotational motion.

Figure 11:
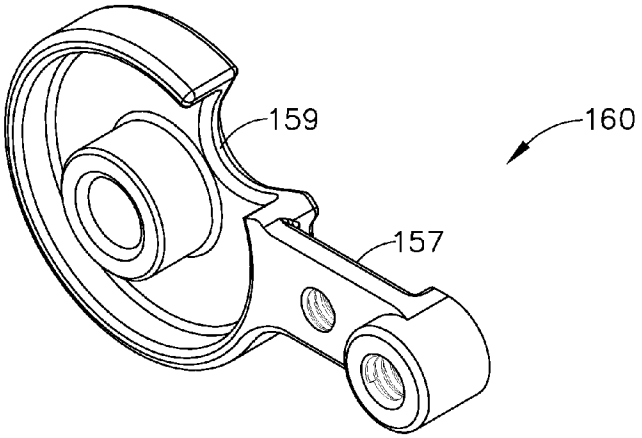
FIG. 11 is a perspective view of the feed pawl of FIG. 2, showing its "bottom side."
Figure 12:
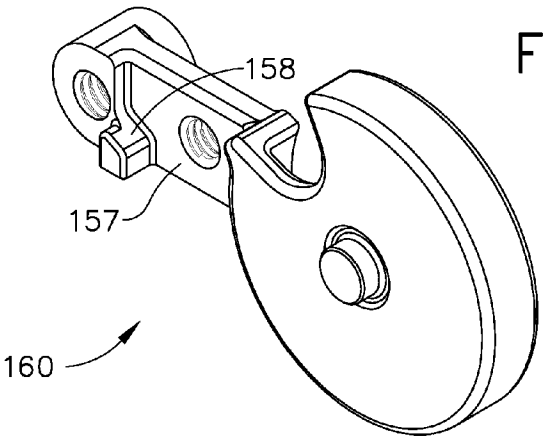
FIG. 12 is a perspective view of the feed pawl of FIG. 11, showing its "top side."
Figure 13:
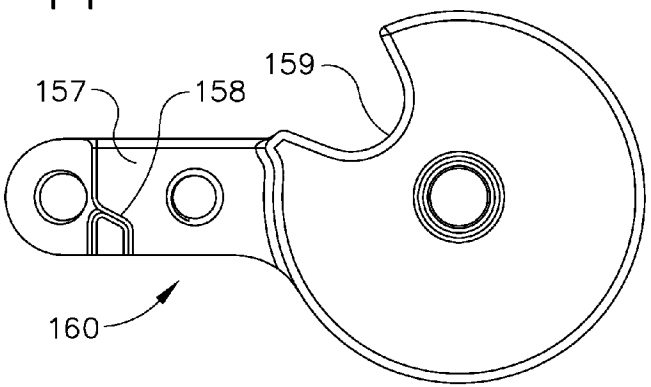
FIG. 13 is a top elevational view of the feed pawl of FIG. 12.

Referring now to FIGS. 11, 12, and 13, the feed pawl 160 is illustrated in greater detail. Feed pawl 160 has a large circular area with a large arcuate depression at 159. It also has an extension arm 157 that has a cylindrical opening at its distal end, and that opening allows it to pivot about the cam screw 72. There is a "feed post" 158 near the distal end of the extension arm 157. The other end of the torsion spring 164 will rest against that post (see FIG. 20).

Figure 14:
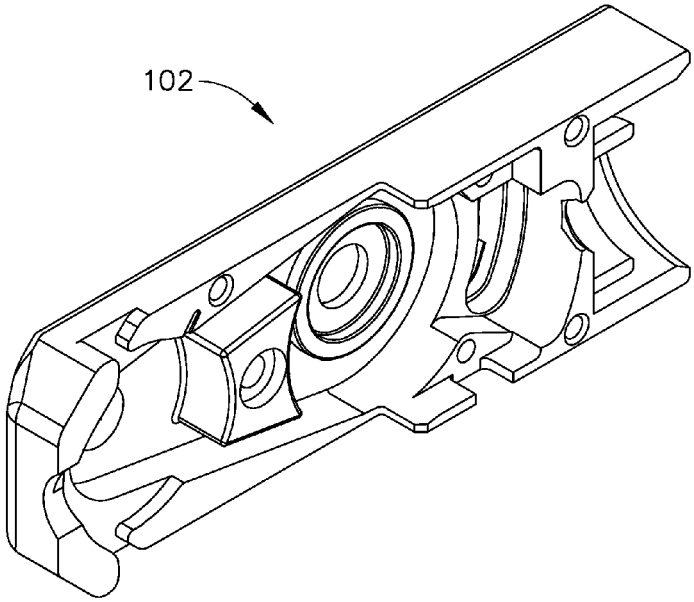
FIG. 14 is a perspective view of the slide body support used in the tool of FIG. 2.
Figure 15:
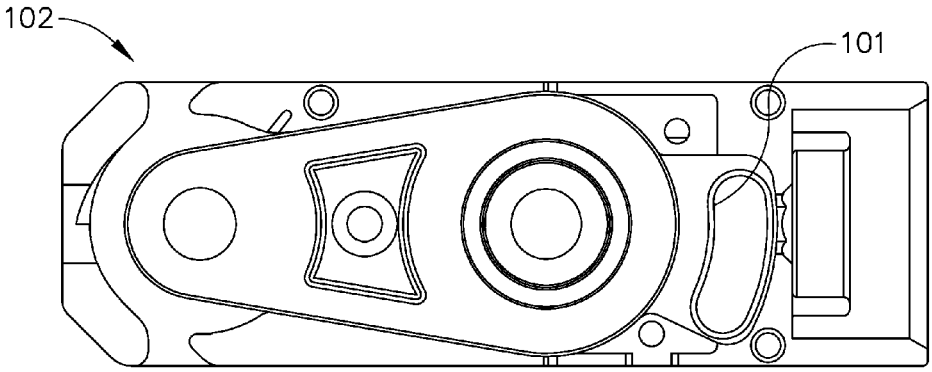
FIG. 15 is a side elevational view of the slide body support of FIG. 14.

Referring now to FIGS. 14 and 15, the slide body support 102 is illustrated. There are circular openings and circular bearing-type surfaces for locating the sprocket and the drive gear elements, and also a near-oval structure that provides a pathway for the time belt. In addition, there is a cam follower clearance slot 101 that the cam follower 70 travels within, which also positions the feed pawl element.

Figure 16:
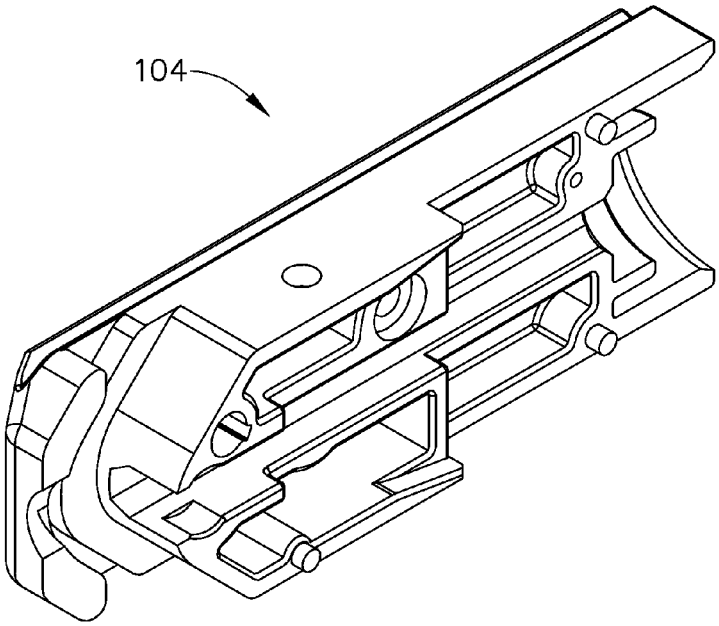
FIG. 16 is a perspective view of the slide body cover used in the tool of FIG. 2.
Figure 17:
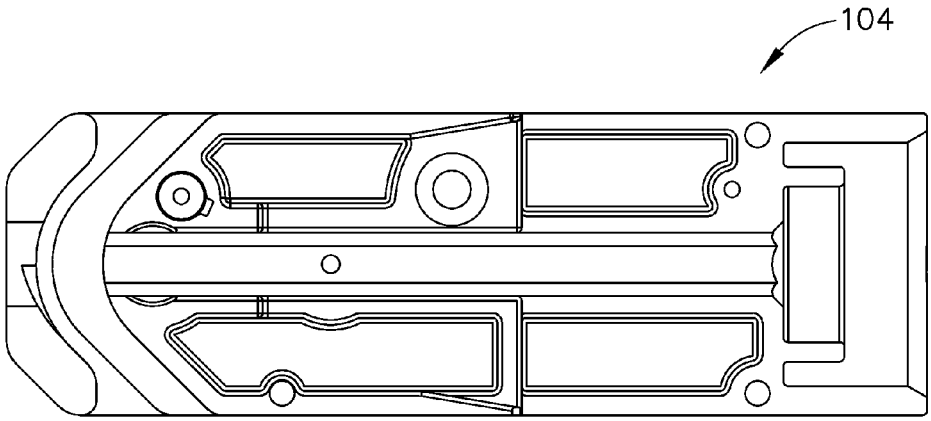
FIG. 17 is a side elevational view of the slide body cover of FIG. 16.

Referring now to FIGS. 16 and 17, the slide body cover 104 is illustrated, which includes various openings for elements such as fasteners and the detent spring 110. In addition, there are locating structures for the nosepiece adjustment subassembly, which includes the plunger 115, cap 112, and spring 116. This nosepiece adjustment subassembly is used for different screw lengths, which can be accommodated by a single tool 10.

Figure 18:
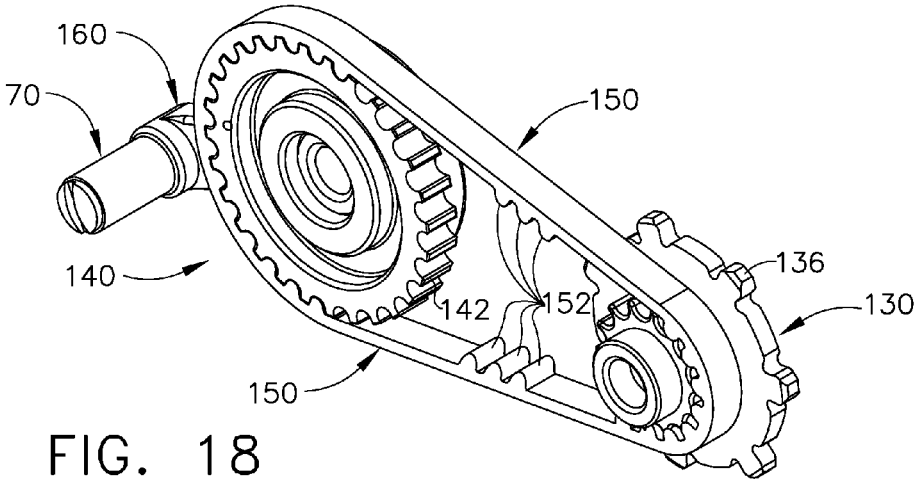
FIG. 18 is a perspective view of the drive belt subassembly of the tool of FIG. 2, showing the components from the "belt side."
Figure 19:
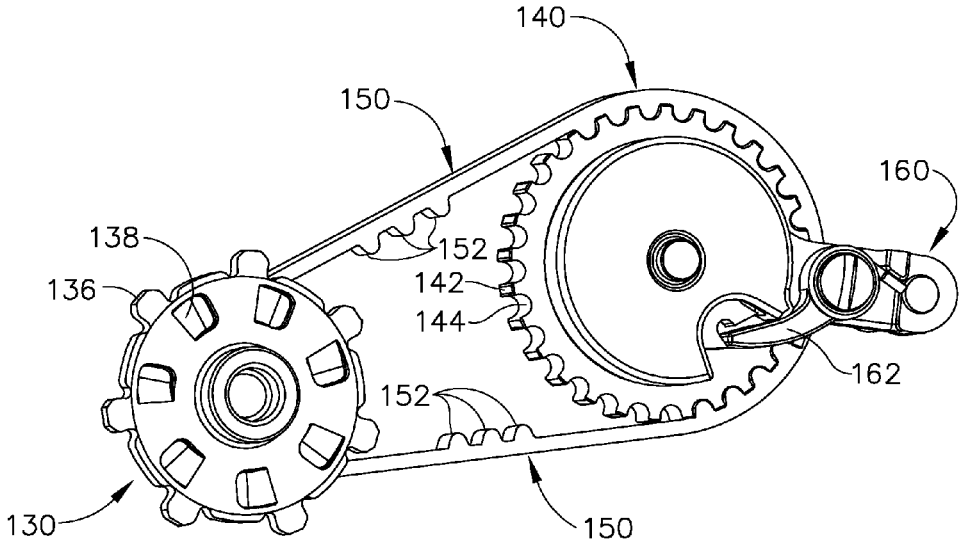
FIG. 19 is a perspective view of the drive belt subassembly of FIG. 18, showing its "detent side."

Referring now to FIGS. 18 and 19, the belt drive subassembly is illustrated, showing the main components of the drive gear 140, sprocket 130, and timing belt 150. The feed pawl 160 is also illustrated, along with its associated detent finger 162. The cam follower 70 is illustrated on FIG. 18, as fitting into an opening at the distal end of the extension of the feed pawl 160.

It will be understood that the timing belt 150 has multiple raised "bumps" (or protrusions) 152, and that these bumps fit into the depressions 144 of the drive gear 140, and to also into the depressions 134 of sprocket 130. However, only a few of these multiple "bumps" 152 are illustrated on FIGS. 18 and 19, for the sake of clarity. But it will be understood that the raised, spaced-apart bumps 152 are actually in place along the entire inner surface of the timing belt 150. The other views of the technology disclosed herein that show the timing belt 150 do not show any of these bumps 152 except at the locations where they actually engage depressions of the sprocket and the timing gear, again for the sake of clarity.

Figure 20:
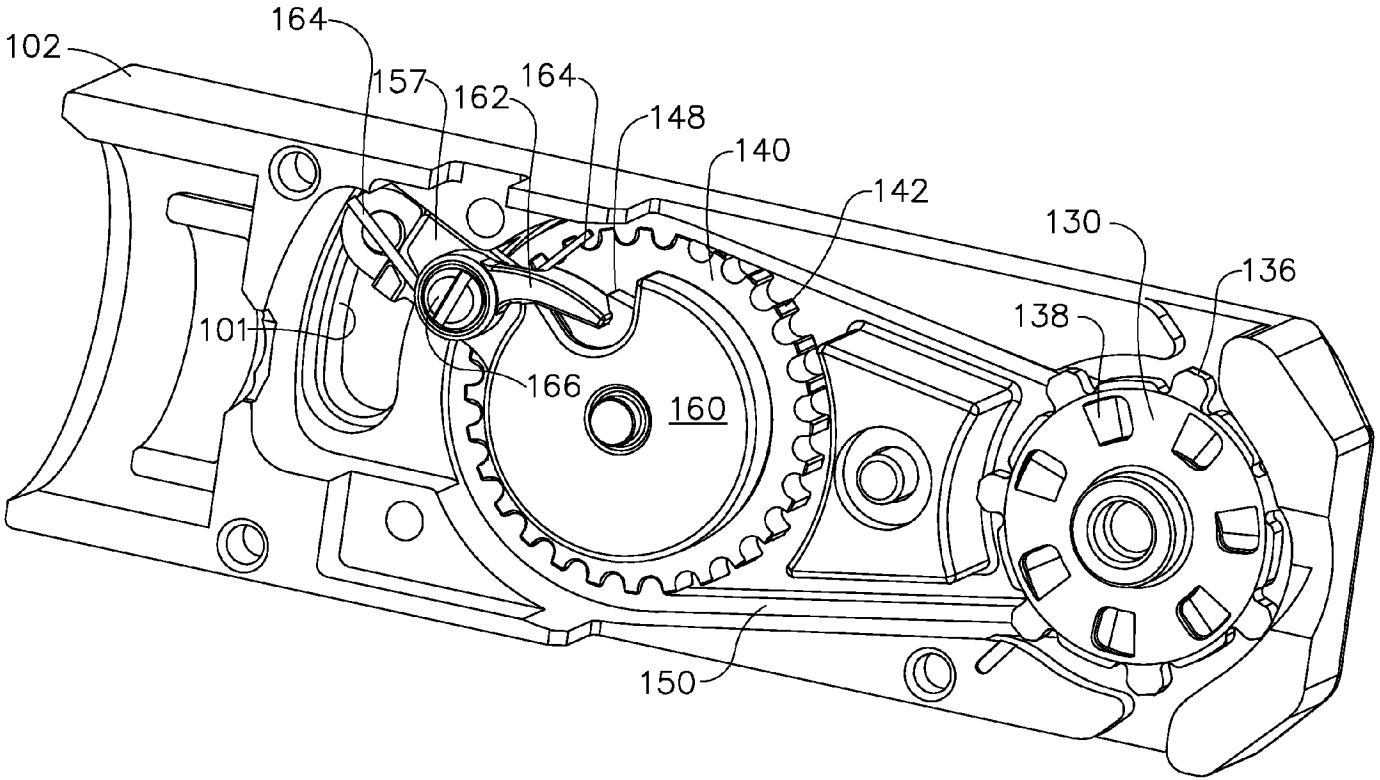
FIG. 20 is a perspective view of the slide body support subassembly, used in the tool of FIG. 2.

Referring now to FIG. 20, the belt drive subassembly is again illustrated, this time as it would be assembled into the slide body support 102. As in FIGS. 18 and 19, the sprocket 130 and the timing gear 140 are illustrated as engaging bumps of the timing belt 150. The interior edge 148 of the drive gear 140 can be seen as engaging the detent finger 162 at its distal end, while the extension 157 of the of the feed pawl can be seen as having its associated cam follower resting inside the curved slot 101.

In addition to the other elements illustrated in FIG. 20, the torsion spring 164 is illustrated, and its two extending arms can be seen on FIG. 20. The torsion spring is centered about a locating pin 166, which holds the detent finger 162 in place in an opening of the feed pawl 160.

When the nosepiece of the tool is pushed against a workpiece surface, this causes a cam arm (or extension) of the feed pawl 160 to rotate about a predetermined radial position for the cam profile until it reaches the dwell slot in the housing (which is the elongated horizontal portion of the slot 28 in the housing 22). The detent finger 162, while engaged into the ratchet teeth of the drive sprocket, causes the drive gear to rotate. This movement causes the timing belt to move, and therefore, the drive sprocket 130 is also rotated simultaneously. This causes the collated strip of screws 60 to move into position so that a fastener can be driven into the workpiece. As noted above, this design acts as a "displacement action mechanism" by converting linear motion (or displacement) into rotational motion.

Once the "lead screw" has been indexed into the drive position 68 during a drive sequence, the slide body subassembly will begin to "compress" (because of the action of pushing the nosepiece against the workpiece surface) to the full drive distance of a given fastener, and this provides a given amount of cornerfit clearance. This term "cornerfit clearance" is defined as the distance from the front of the nosepiece to the front of the outermost housing portion when the tool is completely compressed (i.e., the slide body has been completely pushed into the feed tube). This distance (the cornerfit clearance) is needed for driving a framing square into standard commercial channels while clearing the edges, or for driving a screw into the corrugated roof decking. During the return stage of movement, after a fastener has been driven, the drive gear 140 and driven sprocket 130 stay in position while the ratchet finger 162 rotates about the ratchet teeth and back into position.

It should be noted that the overall design of the illustrated tool allows for an "advance on return" mode of operation, in which the screw or fastener is indexed to the drive position during the return portion of the operating cycle, instead of during the advance portion of that cycle. In this return mode (or "advance on return" mode), as the operator releases the mechanism, the fastener moves into place (at the drive position). The push stroke will reset the mechanism for the next feed stroke.

The operation of this type of screw-driving slide body subassembly is smooth and effortless when driving a fastener, because there are no momentary hesitations in the drive elements themselves.

Figure 21:
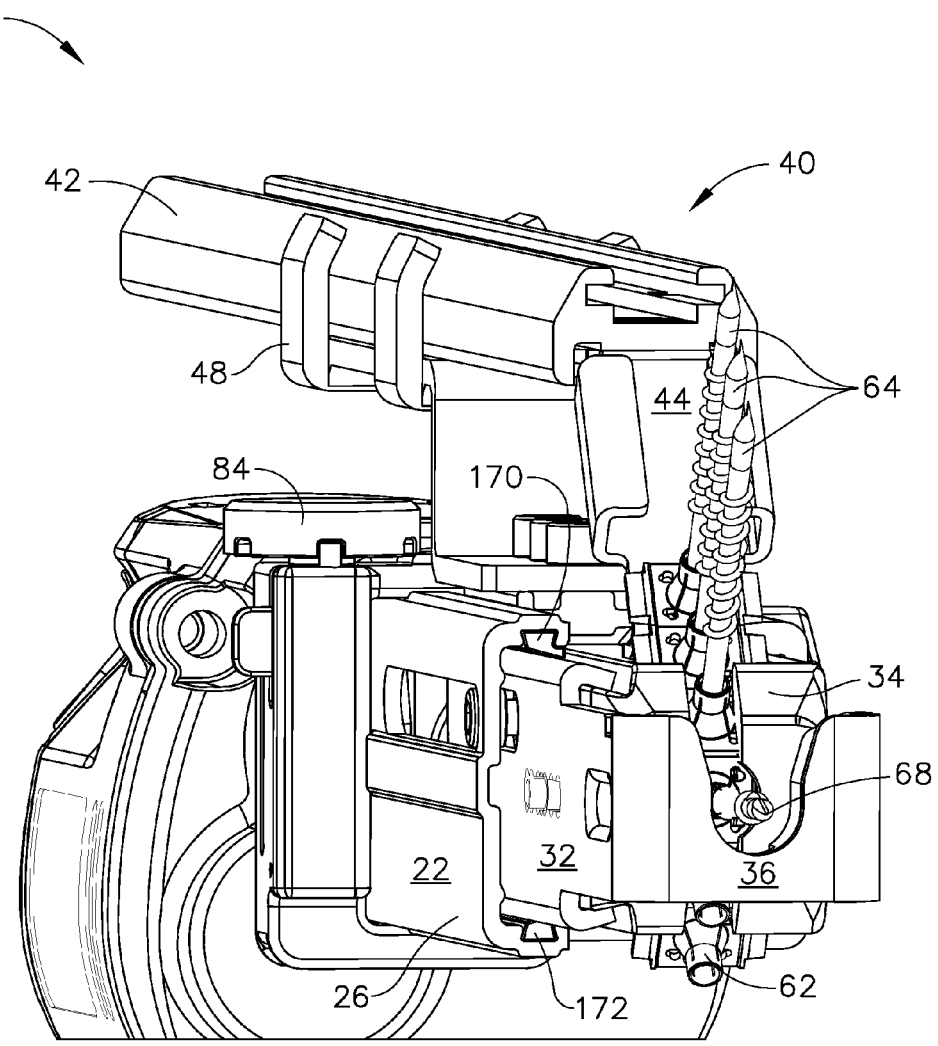
FIG. 21 is a perspective view from the front corner of the tool of FIG. 2, showing the nosepiece, slide body subassembly, feed tube housing, and linear guides.

Referring now to FIG. 21, the attachment tool 10 is illustrated in a perspective view that is mainly from the front, which is the end of the tool that makes contact with the workpiece. As can be seen in this view, the "lead fastener" 68 is visible, as if it were about to be emplaced into the workpiece. The orientation of the nosepiece 32 with respect to the right side of the housing 22 can be seen, and this also illustrates the linear guides 170 and 172, which will be discussed below in greater detail.

Figure 22:
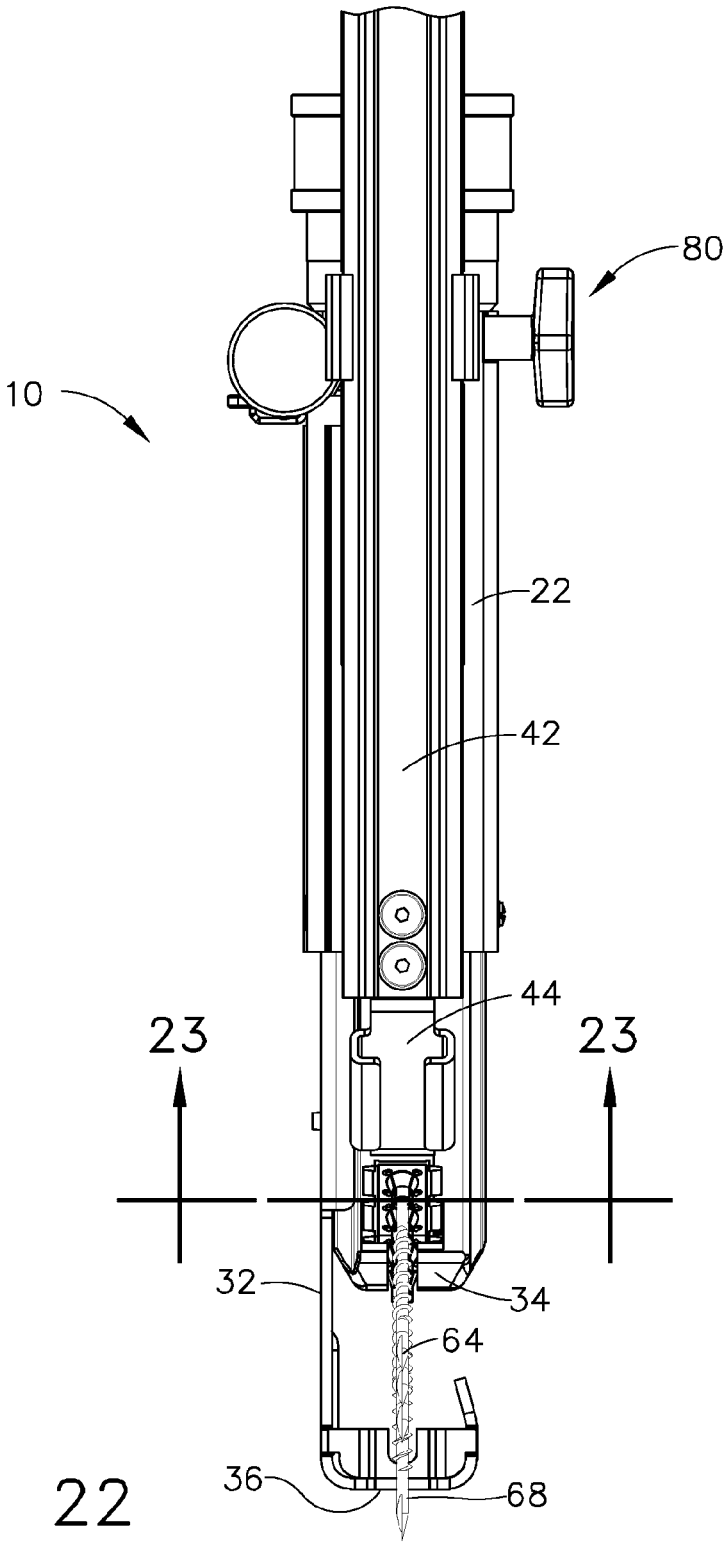
FIG. 22 is a top plan view of the front end of the tool of FIG. 2, showing the tool in its unactuated position, with the nosepiece extended.

Referring now to FIG. 22, a top plan view of the attachment tool 10 is illustrated, in which the tool is in its non-actuated condition. The "lead" fastener 68 is illustrated, along with some of the other fasteners 64 that are still connected to the collated strip. (In reality, the "lead" fastener 68 will no longer be attached to the collated strip if this tool was an "index on advance" tool.)

Figure 23:
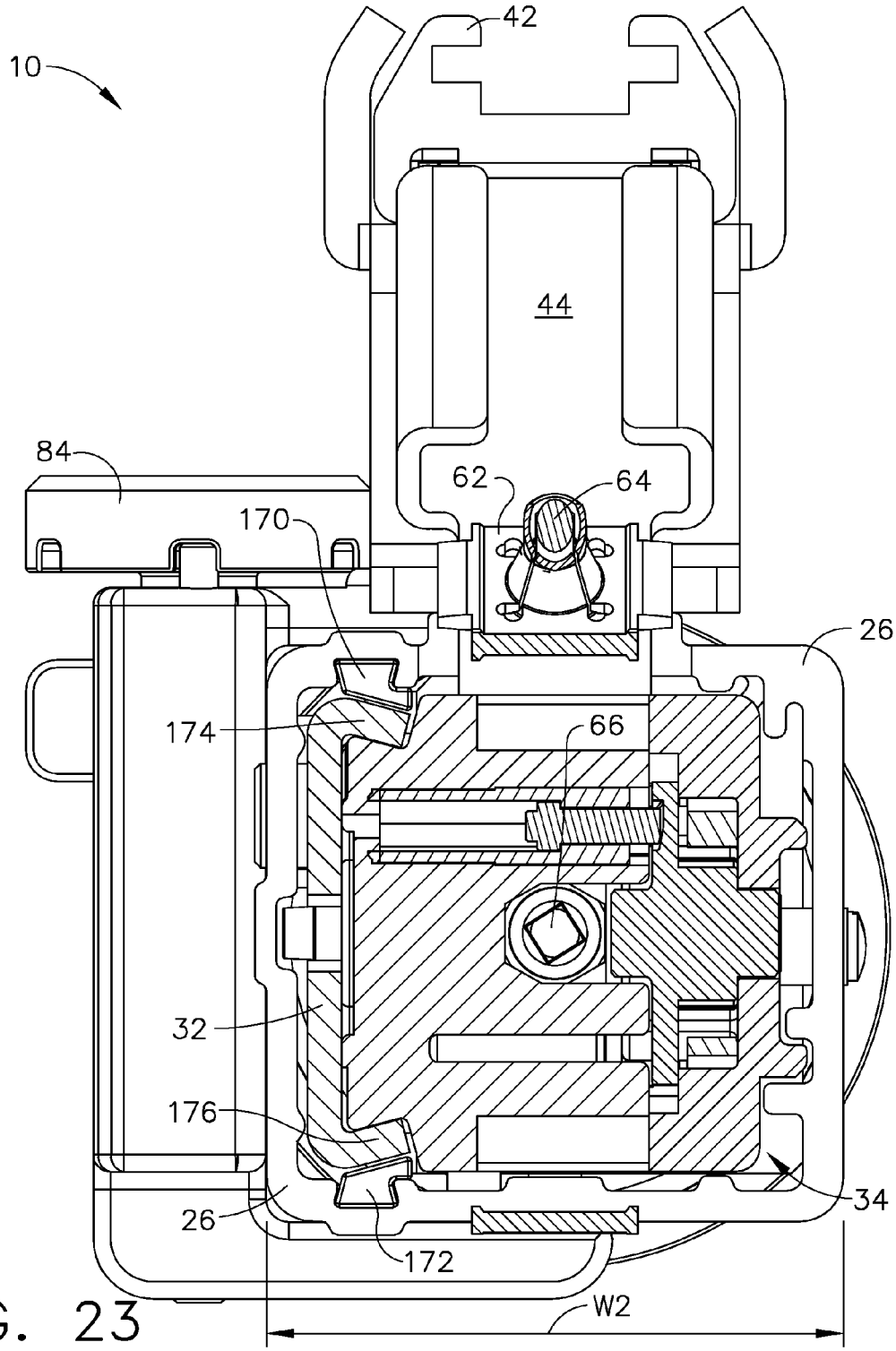
FIG. 23 is a cross-section view from the front of the tool of FIG. 22, taken along the section line 23-23.

FIG. 22 shows a section line 23-23, and FIG. 23 is a cross-section view of the tool 10 taken along the section line. Referring now to FIG. 23, the feed tube 26 outer framework can be seen, as a largely square-shaped structure. Within the square frame 26 are the slidable workings of the slide body subassembly 34. In the middle of the slide body subassembly is the drive bit at 66. Above the slide body subassembly is the collated screw strip 62, with a portion of one of the fasteners 64 still attached. These would be arriving at the drive position by sliding along the guide rails 42 and 44.

Certain details can be easily discerned in FIG. 23. The feed tube 26 is easily seen, as having a square profile and shape. Within that feed tube are the linear guides 171 and 172. These guides make contact with the nosepiece 32 and angled portions of the nosepiece designated at the reference numerals 174 and 176. This is referred to herein as a "dove-tail" shape, and provides fairly rigid support for the nosepiece 32 as it slides forward and backwards along the bearing surfaces of the linear guides 170 and 172. It can be seen that the angled nosepiece portions 174 and 176 slide along similarly angled surfaces of the linear guides 170 and 172. This is an important feature of the technology disclosed herein, because it provides strong support for the movable nosepiece and movable slide body subassembly 34, especially along the "right-hand side" (which is to the left in this view) where the nosepiece is positioned toward the front of the tool attachment 10.

Figure 24:
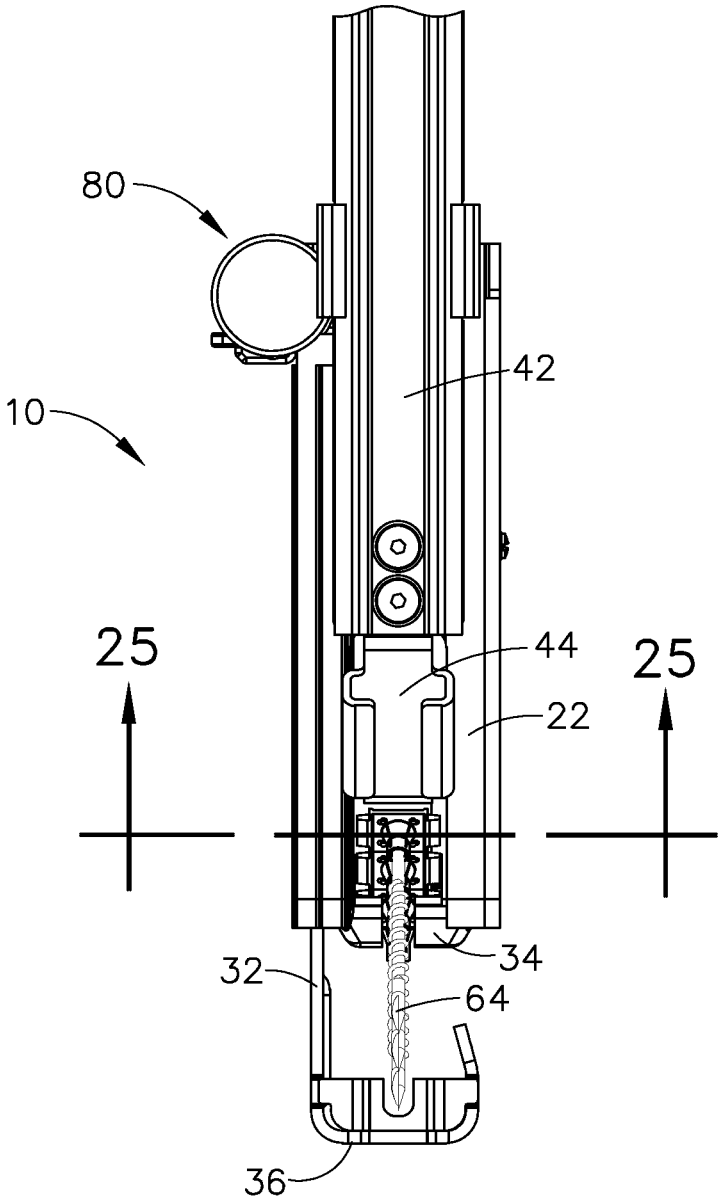
FIG. 24 is a top plan view of the front portion of the tool of FIG. 2, showing the tool in its actuated position, with the nosepiece pushed somewhat into the feed housing.

Referring now to FIG. 24, the front portion of the attachment tool 10 is illustrated in a top plan view, and this time it has been actuated so that the slide body subassembly 34 has been pushed into the feed housing 22. The "lead fastener" 68 has been torn away from the collated strip 62, and the screws (or fasteners) 64 that are visible on FIG. 24 have not yet reached the drive position, and they are still attached to the screw strip 62.

Figure 25:
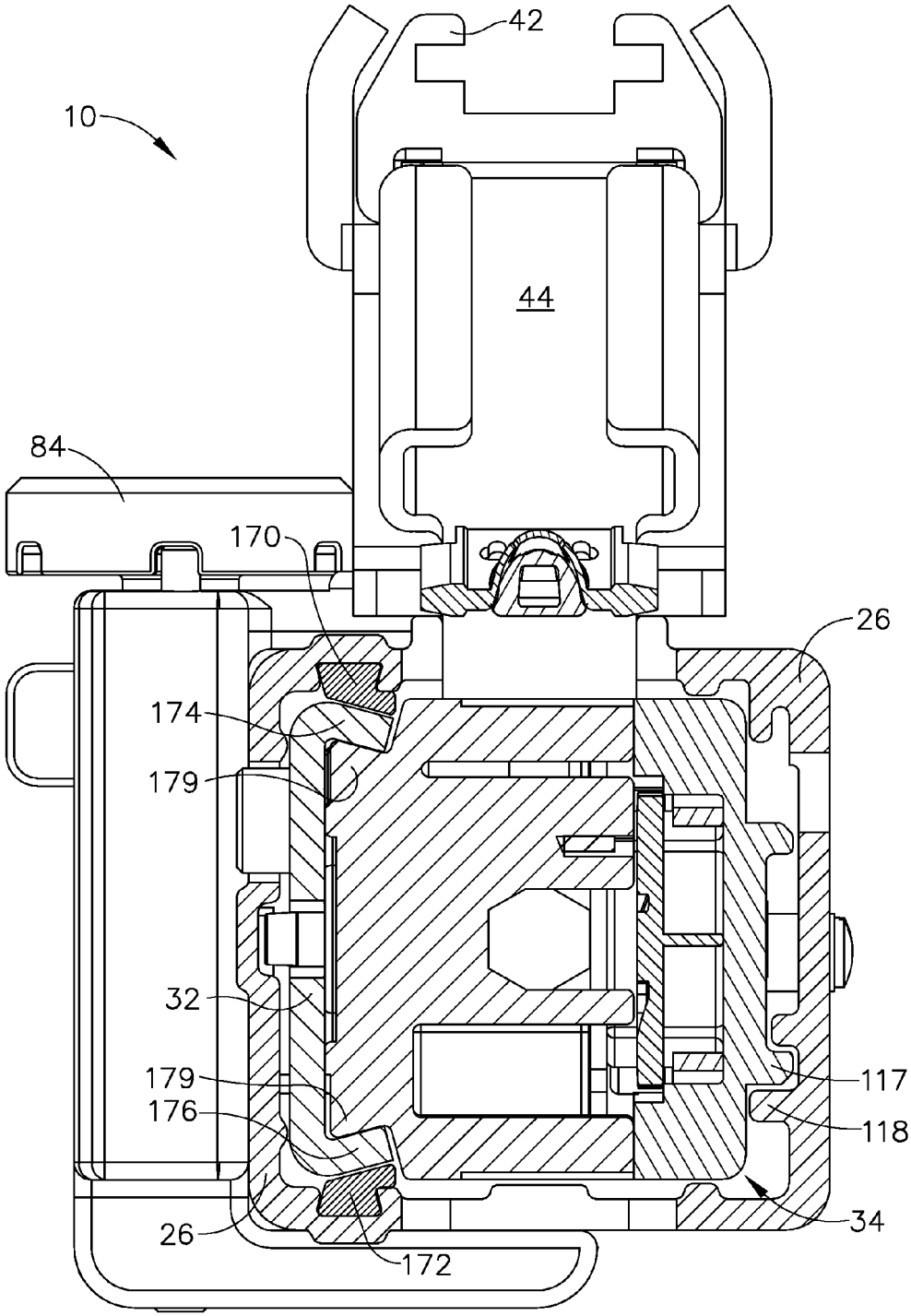
FIG. 25 is a cross-section view of the front of the tool of FIG. 24, taken along the section line 25-25.

A section line 25-25 is depicted on FIG. 24, and FIG. 25 is a cross-section view taken along that line. In FIG. 25, the attachment 10 is illustrated, and shows the components of slide body subassembly 34 essentially surrounded by the feed tube 26. Just to the outside of the feed tube, along the "right-hand side" of the tool, is the nosepiece 32 (to the left in this view). There are two linear guides 170 and 172 that make a low-friction contact with two extensions 174 and 176 of the nosepiece 32. This is the same orientation that was illustrated in FIG. 23. The linear guides 170 and 172 act essentially as linear bearings for the movement of the nosepiece 32 proximal to and just inside the right-hand interior surface of the feed tube 26. As noted above, this provides a firm structure for the combination of the nosepiece 32 and the slide body subassembly 34, as they move inside the feed tube 26.

The dovetail shape of the nosepiece 32 is evident, in which the outer corners along the right-hand side are broader, or spaced-apart at a greater distance, than the distal ends of the extensions 174 and 176. The nosepiece 32 is tracked (guided) within the feed tube 26, primarily on one side. There are additional features 177 and 178 on the slide body support to balance the load. Most conventional automatic feed screw systems use the slide body subassembly as the sole means of support within the feed housing. Sizing of the inside housing dimensions becomes critical with those previous designs.

The dovetailed slide body cover at 179 allows the nosepiece 32 to slide and track smoothly along the slide body cover when making screw length adjustments, by adjusting the nosepiece position holes 38. As noted above, this dovetailed feature is also the primary support for the slide body subassembly 34. Similar to the nosepiece 32, there are portions (at 179) that have outer corners that are broader (i.e., spaced-apart at a greater distance) than their more interior outer surfaces. When fastened together, the combination of the slide body cover at 179 and the nosepiece portions 174 and 176 create a single body structure during normal operation of the tool 10, for driving a fastener into a workpiece; the nosepiece portions 174 and 176 are sometimes referred to herein as a "dovetail shaped body member."

The upper and lower linear guides (or bearings) 170 and 172 are made of a material having a low coefficient of friction, such as TEFLON. They support the nosepiece, inside the feed housing 22. The tapers on these linear guides "lock in" the nosepiece 32, and bias it to one side. As can be seen on FIG. 25, the angled shape (the taper) of linear guides 170 and 172 correspond to the angled shape of the dovetail outer surface of the nosepiece 32, specifically at their outer sliding surfaces at the portions 174 and 176. In this manner the dovetailed surfaces of the slide body subassembly provide a stronger, more durable surface along the guide rails and support the extending mechanism within the slide body subassembly, thereby having an improved linear tracking capability.

Figure 26B:
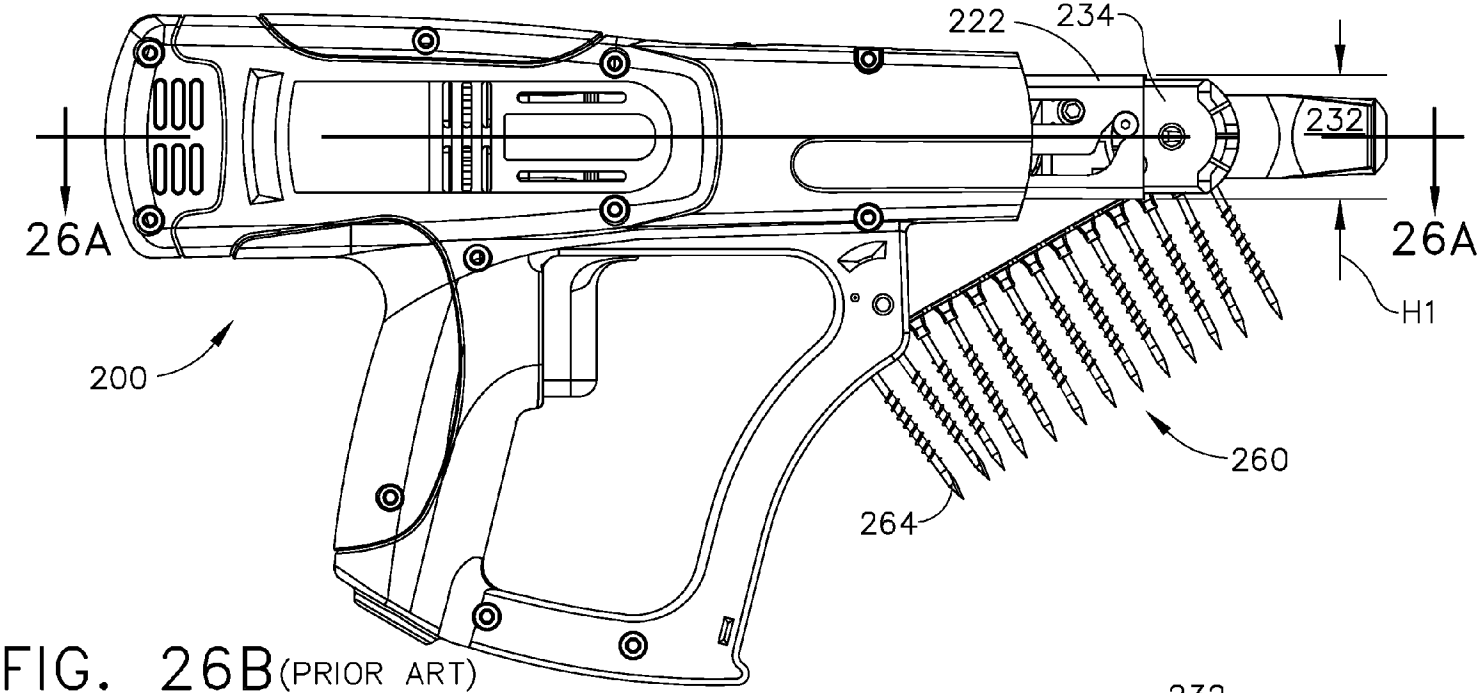
FIG. 26B (PRIOR ART)
FIG. 26B, which is a side elevational view taken from the right side of the tool.
Figure 26A:
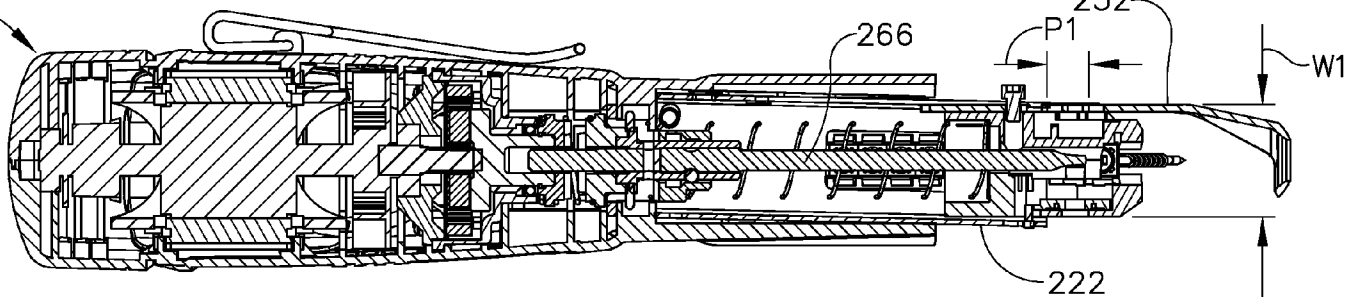
FIG. 26A (PRIOR ART)
FIG. 26A, which is a top plan view in cross-section.

Referring now to FIG. 26, a prior art automatic screwdriver, generally designated by the reference numeral 200, as two views: FIG. 26A, which is a top, plan view in cross-section, and FIG. 26B, which is a side elevational view. This is a representation of an existing prior art sold by Senco Brands, Inc., which is the model number DS200-AC. This is an integral tool, which includes all of the motorized and trigger components, as well as the final drive components, including the collated strip indexing components.

The "front end" of the tool 200 is on the right side of the view in FIG. 26. This includes a feed tube 222, a movable slide body subassembly 234, and the movable nosepiece 232. A screw strip subassembly 260 is visible in FIG. 26B, which has a plurality of individual screws 264.

As best seen in the section view FIG. 26A, there is a drive bit 266 that extends from the motorized gearbox portion of the tool toward the front end of the tool, so that it will engage with one of the screws 264 when the tool is actuated.

There are certain dimensions of importance that are depicted on FIG. 26. In the side view FIG. 26B, the dimension "H1" represents the height of the outer dimension of the feed tube 222. In the section view FIG. 26A, the dimension "W1" represents the width of the outer portion of the feed tube 222. A dimension "P1" represents the distance from the furthermost end (the "distal" end) of the drive bit 266 to the furthermost end (or "distal" end) of the feed tube 222. This P1 dimension is also referred to as the "lick-out" characteristic of the tool.

The lick-out characteristic of a power tool is important, and in general, it is better to have a longer lick-out dimension than a shorter one. This is because a longer lick-out dimension will allow a tool to reach into smaller, tighter places to drive a fastener than a tool that has a shorter lick-out dimension. Since the automated screwdriver tools using collated strips of fasteners tend to be designed with a front-end portion that "collapses" into a feed tube, it usually is the outer dimensions of the feed tube that becomes the controlling factor as to whether a given tool can reach into a small working area, or not. Therefore, the longer the lick-out dimension compared to the overall size of the feed tube, the more "small" areas the tool can be used with. This can be expressed as a ratio: either P/H (the lick-out divided by the feed tube height) or P/W (the lick-out divided by the feed tube width) for a square or rectangular feed tube.

Figure 27B:
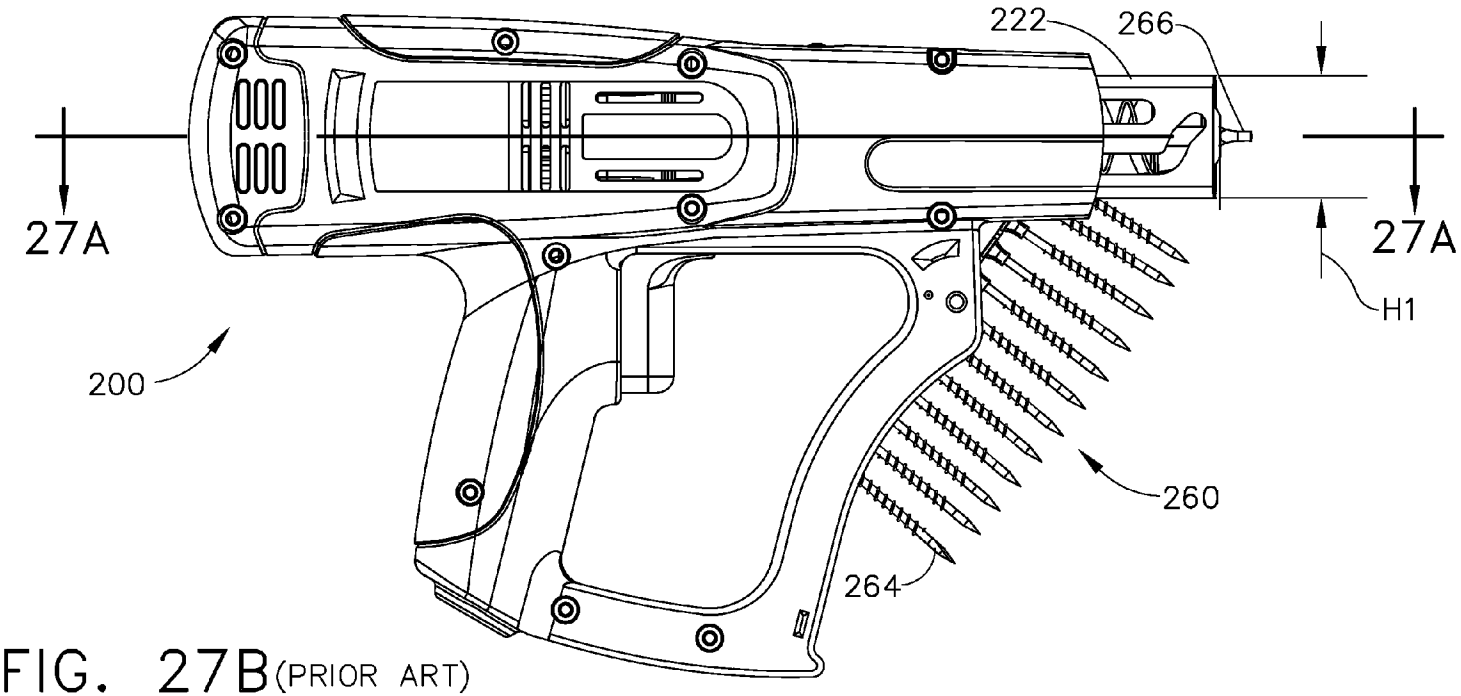
FIG. 27B (PRIOR ART)
FIG. 27B, which is a side elevational view taken from the right side of the tool.
Figure 27A:
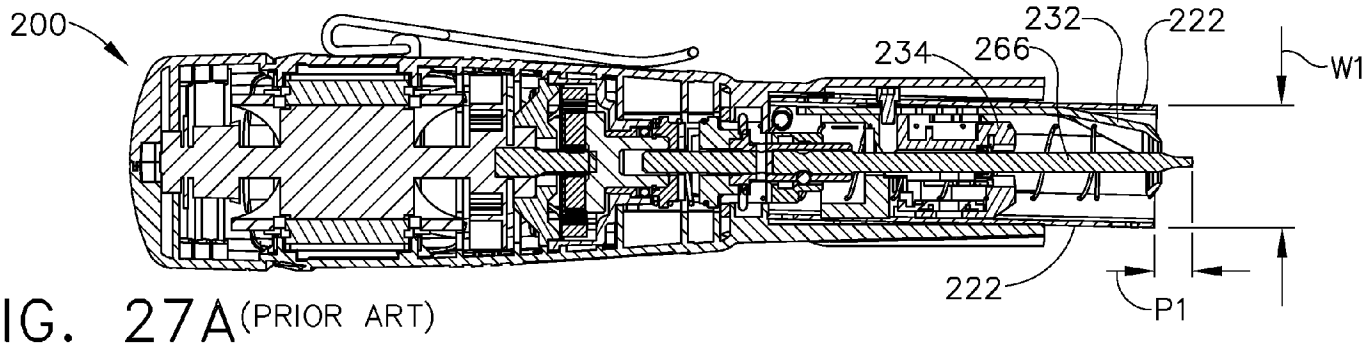
FIG. 27A (PRIOR ART)
FIG. 27A, which is a top plan view in cross-section.

This characteristic described in the previous paragraph is better illustrated in FIG. 27. FIG. 27A illustrates a top, plan view in cross-section of the same prior art tool, model DS200-AC, after the tool has been "collapsed" because its nosepiece has been pushed against the surface of a workpiece, which means the tool was used to drive a fastener into that workpiece. FIG. 27B is a right side elevational view of the same tool, under the same conditions. As can be seen, the slide body subassembly 234 has been pushed quite far into the feed tube 222, and the nosepiece 232 has been pushed back almost all the way to the outer edge of the feed tube 222. This "outer edge" of the feed tube 222 is also referred to herein as its "distal end." In this condition, the drive bit 266 is the component of the tool that is furthermost to the front end of the tool.

In this "collapsed" condition of the tool 200 depicted in FIG. 27, the lick-out dimension P1 is easily seen as the distance between the distal end of the drive bit 266 and the distal end of the feed tube 222. This dimension does not change for a particular tool as the tool is operated. It merely looks different, because the slide body and nosepiece have been pushed into the inner open spaces of the feed tube 222.

The actual dimensions for a Senco model DS200-AC are as follows:

Dimension P1=11.89 mm

Dimension H1=38.1 mm

Dimension W1=38.1 mm

While it might seem a simple task to merely extend the lick-out dimension (i.e., dimension P1 of FIGS. 26 and 27), this cannot be merely extended without considering how it will affect the operation of the tool. If the slide body and nosepiece are merely pushed farther forward without increased support from the feed tube, then the operation of the tool will become unstable, and the fasteners (typically, screws), will start having misfires, and the reliability of the tool will be compromised. On the other hand, if the feed tube is also enlarged to make for a more robust and stronger design, then that defeats the purpose of extending the lick-out dimension, because the larger feed tube itself will prevent the tool from being used in small areas. Therefore, the ratio of the lick-out dimension over the length (or width) of the feed tube is an important quantity. In the Senco model DS200-AC, this ratio is as follows:

P1/H1=11.89 mm/38.1 mm=0.312

P1/W1=11.89 mm/38.1 mm=0.312

The greater this ratio P/H, or P/W, then typically the better the capability of such an automatic screwdriver tool for operation into small areas, such as for driving a rotatable fastener (e.g., a screw) into the interior corner of a structure, or for driving a framing screw into standard commercial channels while clearing the edges of the channel, or for driving a screw into deep corrugated roof decking.

Figure 28:
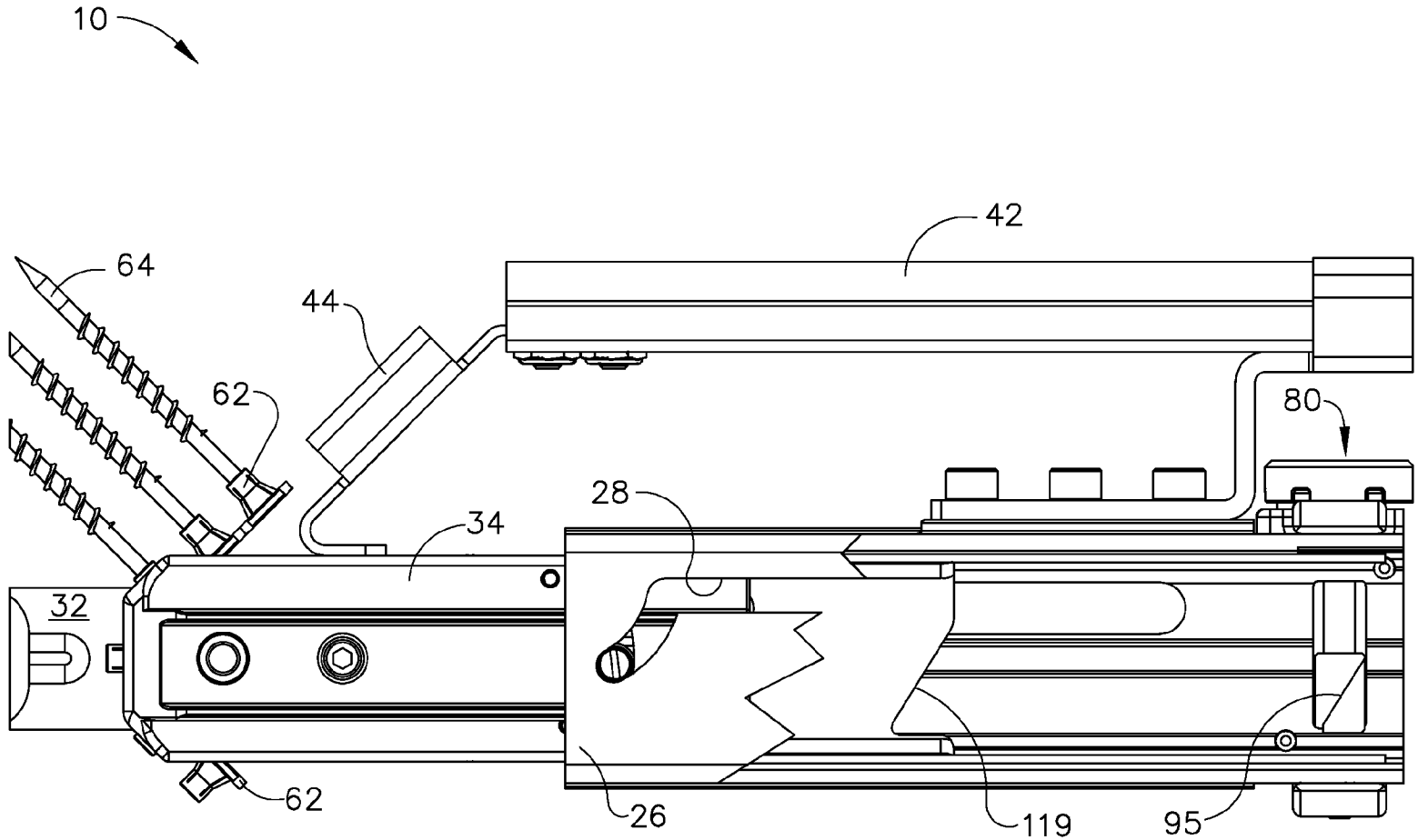
FIG. 28 is a side elevational view of the tool of FIG. 2, in its unactuated state.

Referring now to FIG. 28, a left-side elevational view of the technology disclosed herein is illustrated, showing the front end portions in greater detail. This includes the nosepiece 32, the movable slide body subassembly 34, and the feed tube 26, with its camming surface or slot 28. Also visible are the guide rail 42 and its forward extension 44, and the collated strip of screws 60, in which the strip itself is at 62, and the screws at 64. Finally, the depth of drive subassembly 80 is visible, having an inclined surface 95. This tool is shown in the unactuated position, in which the nosepiece and the slide body subassembly are fully extended, away from the feed tube 26.

Figure 29:
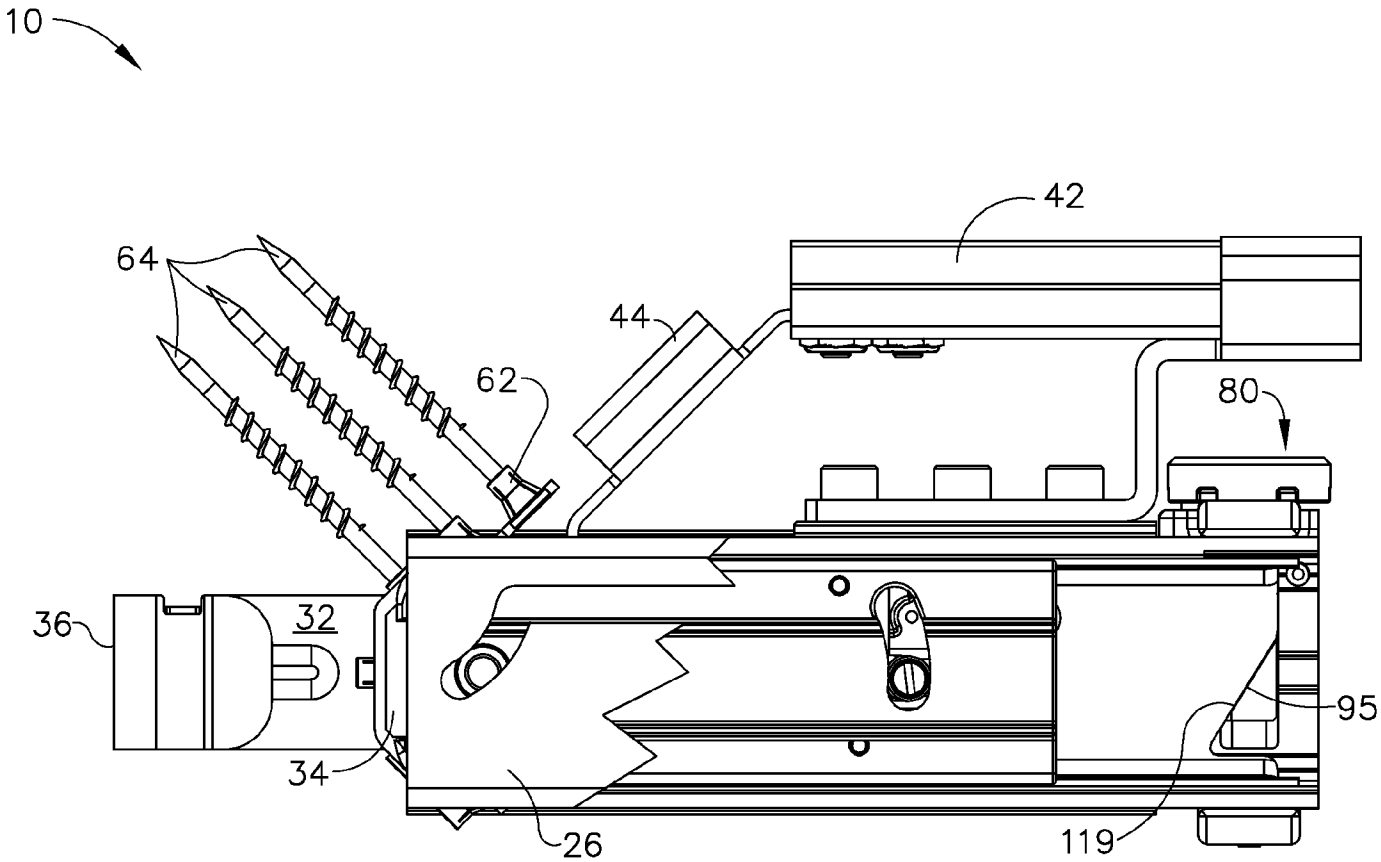
FIG. 29 is a side elevational view of the tool of FIG. 2, in its actuated state.

Referring now to FIG. 29, the same tool is seen in the same type of view, except now the tool has been collapsed by which the nosepiece has been pushed in (to the right) due to an operation for driving a fastener. In this view, it can be seen that the movable nosepiece 32 and movable slide body subassembly have been pushed into the feed tube 26 as far as is possible, and therefore, most of the slide body subassembly is not visible, except for the fact that this view is in partial cut-away. Note that the angled rear edge 119 of the nosepiece 32 has contacted surface 95 of the depth of drive subassembly 80.

Referring now to FIG. 30, the tool's front end 10 is again depicted in an elevational view, but this time the cover of the slide body subassembly has been removed. In essence, this is the same view as FIG. 28, without the slide body cover.

The sprocket 130 and the drive gear 140, along with the timing belt 150 are now visible, along with the drive bit 66. A portion of the sprocket 130 has been cut away, so that the distal end of the drive bit can be seen. A dimension "P2" is illustrated, which is the "lick-out" dimension of this tool 10; it is the distance between the forward-most distal end of the drive bit 66 and the forward-most distal end of the feed tube 26. Also visible on FIG. 30 is the height dimension "H2", which is the height of the outer surfaces of the feed tube 26. The width dimension of this feed tube was illustrated on FIG. 23, by the dimension "W2".

FIG. 31 shows the same structure, but in the condition in which both the nosepiece 32 and the slide body subassembly 34 have been partially pushed into the feed tube 26. The distance the nosepiece has been pushed into the feed tube is sufficient to move the outer or distal end of the drive bit 66 much closer to the head of the lead screw 68, as seen in the cut-away area in the sprocket region. The camming roller 70 has been displaced by an amount sufficient to index the sprocket 130, so that the "next" fastener 64 will be indexed to that drive location 68.

The lick-out dimension P2 is again visible on FIG. 31, and extends from the distal end of the feed tube 26 to the distal end of the drive bit 66. In the tool 10, exemplary dimensions that are illustrated on FIGS. 30 and 31 (and also FIG. 23) are as follows:

P2=45.88 mm

H2=38.1 mm

W2=38.1 mm

Using the above figures, the ratio of the lick-out dimension compared to the height (or width) dimension is as follows:

P2/H2=45.88 mm/38.1 mm=1.204

P2/W2=45.88 mm/38.1 mm=1.204

As can be seen, this ratio value (1.204) is much higher than the ratio of the prior art tool discussed above, which was the ratio P1/H1 (and P1/W1). This allows the tool 10 to fit into smaller areas for driving rotatable fasteners, such as screws or bolts.

It will be understood that the feed tube that is illustrated and described herein need not be square; rectangular feed tubes are also common in these types of tools. However, the internal workings of the slide body subassembly must still fit within such feed tubes, no matter their exact shape or size, and a robust slide body subassembly will always require some minimum front profile, having a maximum height or width dimension, which would also be true for a circular or elliptical feed tube. In any feed tube shape, there will always be a discernable width or height dimension (or a diameter dimension) that becomes the limiting factor in allowing the fastener driving tool to fit within a given small area and have the capability of driving a rotatable fastener. Those discernable width or height dimensions will be equivalent to the "W" and "H" dimensions discussed herein.

It would be an improvement to provide a design that provides a ratio of P/W and/or P/H that is at least 0.5; a more preferred design would provide a ratio of P/W and/or P/H that is at least 0.75; a yet more preferred design would provide a ratio of P/W and/or P/H that is at least 1.0; and a still more preferred design would provide a ratio of P/W and/or P/H that is at least 1.2.

Figure 32:
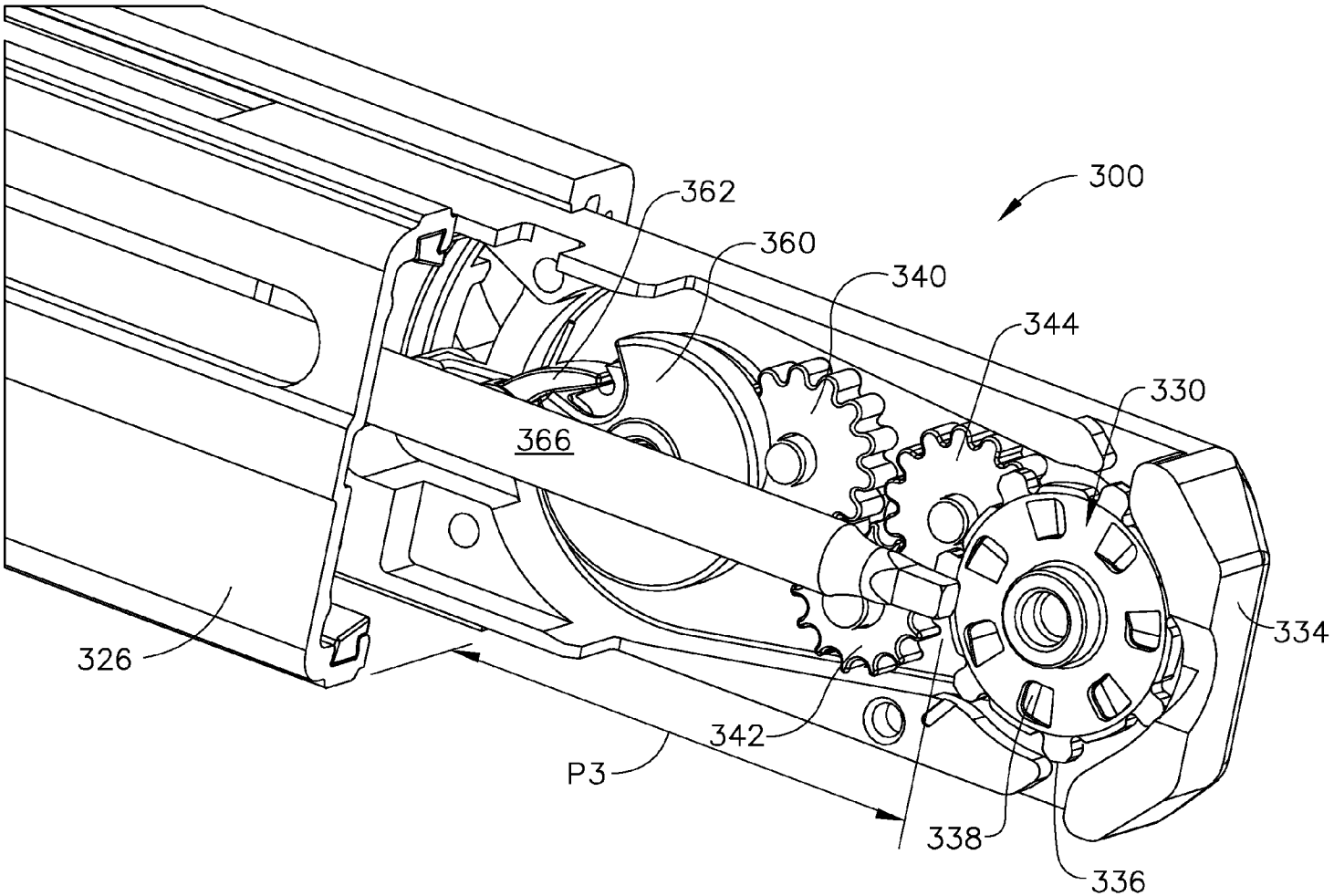
FIG. 32 is a perspective view of an alternative embodiment tool of the technology disclosed herein, showing the extending mechanism as being completely gear-driven, rather than belt-driven.

Referring now to FIG. 32, an alternative embodiment of a fastener driving tool is illustrated, generally designated by the reference numeral 300. In this view, there is a fixed feed tube 326, and a movable slide body subassembly 334. (The nosepiece is not shown, for purposes of clarity.) There is a sprocket 330 to index the collated strip of screws (not seen in this view), and a drive-gear equivalent, which is the feed pawl 360 in this embodiment. The driving feed pawl 360 has an associated drive gear with external teeth (not visible in this view) that causes another rotatable gear 340 to rotate, which in turn causes yet another rotatable gear 342 to be rotated, and which in turn, causes yet another rotatable gear 344 to be rotated. The teeth of the gear 344 will engage the teeth of the sprocket 330, on the opposite side of the sprocket from what is visible in FIG. 32.

The feed pawl 360 has a large opening that is actuated by the detent finger 326, so that this subassembly acts as a ratchet. It will be seen that, as the feed pawl 360 rotates, so do the gears 340, 342, and 344, which then causes the sprocket 330 to rotate, and thereby to index the collated strip of screws. This can be built as a sturdy "extending mechanism", and the multiple drive gears can be made as large as necessary, so long as they fit within the confines of the interior spaces of the slide body subassembly 334.

On FIG. 32, the lick-out dimension is designated as "P3" which is the distance from the distal end of the drive bit 366 to the front (or distal) end of the feed tube 326. Once again, this is a rather long dimension, as compared to the length and width of the feed tube itself. This will provide improved characteristics for fitting within small areas for driving rotatable fasteners, such as screws or bolts.

Figure 33:
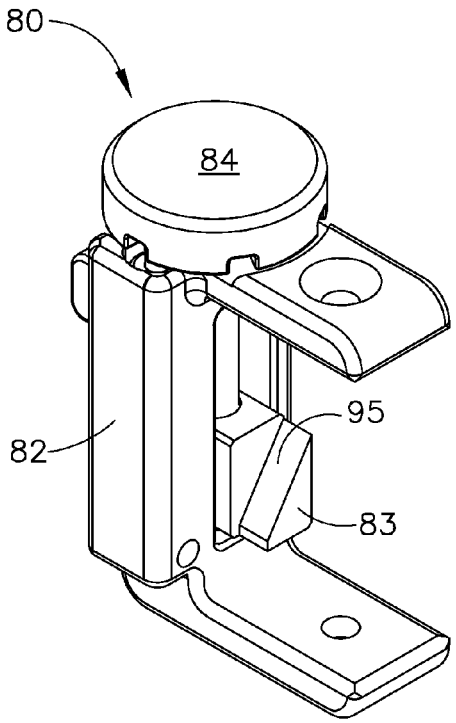
FIG. 33 is a perspective view of the adjustable depth of drive subassembly used in the tool of FIG. 2.
Figure 34:
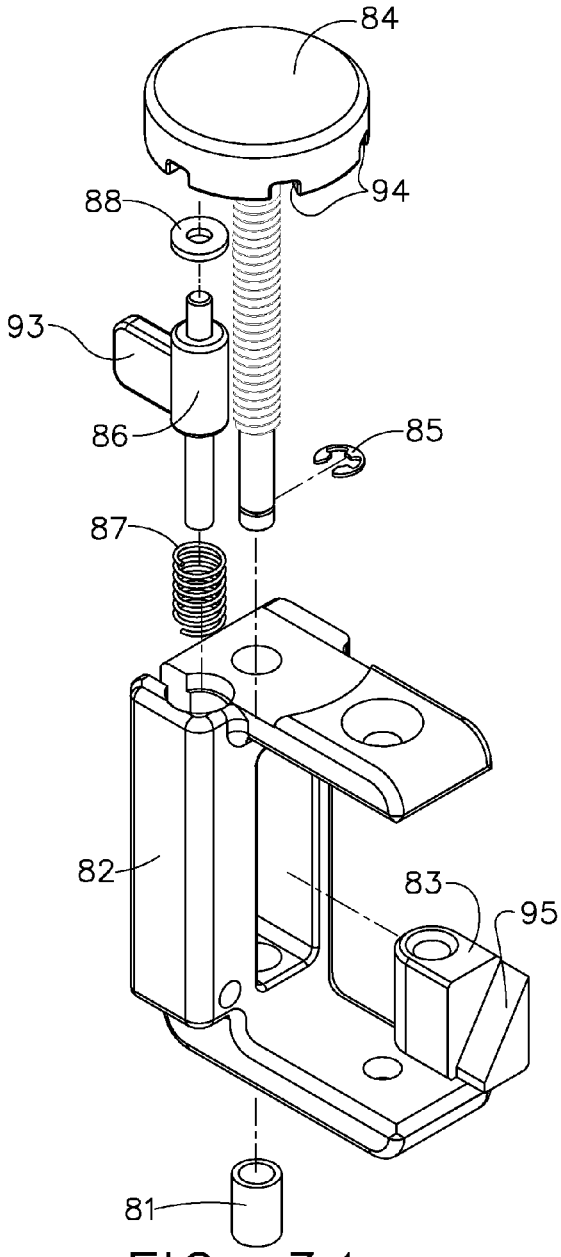
FIG. 34 is an exploded view of the depth of drive subassembly of FIG. 33.
Figure 35:
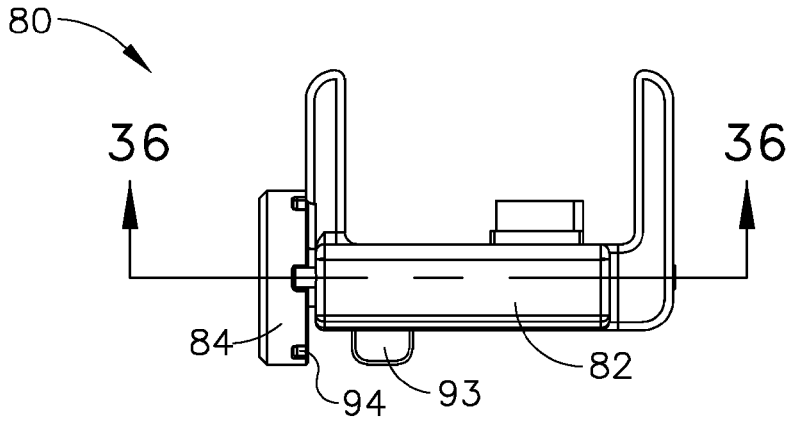
FIG. 35 is side-elevational view of the depth of drive subassembly of FIG. 33, with the subassembly on its side.
Figure 36:
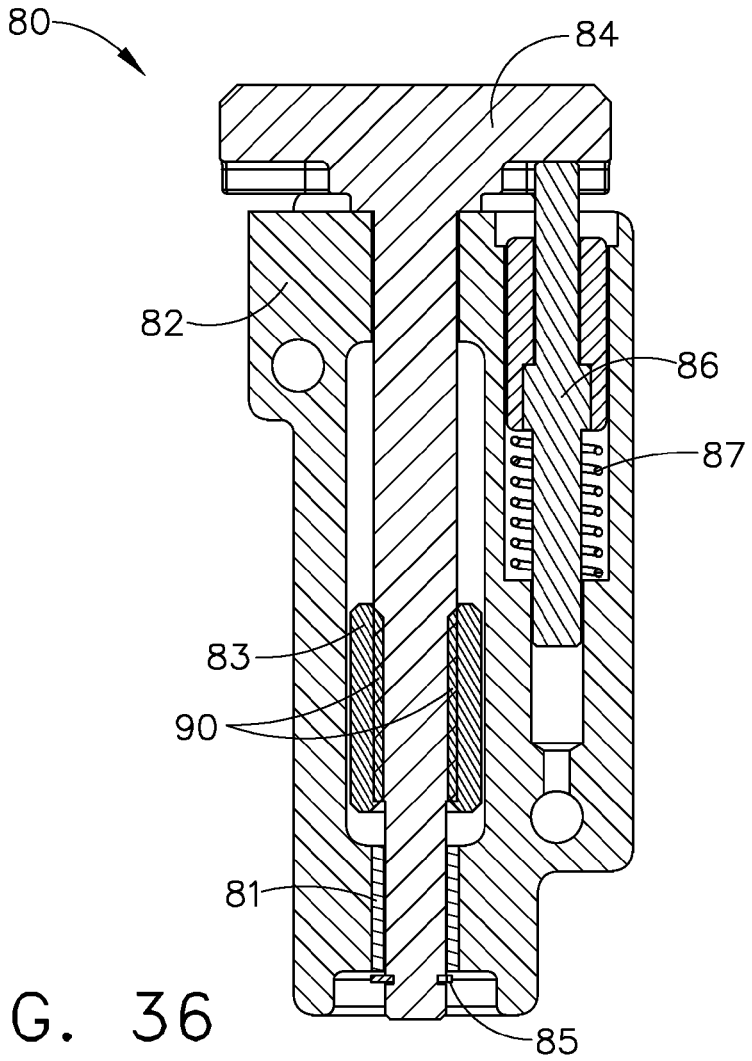
FIG. 36 is a cross-section view of the depth of drive subassembly of FIG. 33, taken along the section line 36-36 of FIG. 35.

Referring now to FIGS. 33-36, a depth of drive subassembly is illustrated, generally designated by the reference numeral 80. This subassembly includes several components, such as a adjusting screw bushing 81, a housing 82, an adjustable stop block 83 which is threaded, a threaded adjusting screw 84 having a large knob, a retaining clip 85, a locking latch pin 86, a compression spring 87, and a latch pin retainer 88. The latch pin 86 has a protruding tab 93, the adjusting knob/screw 84 has recesses 94 on the bottom surface of the knob, and there is an angled (or inclined) surface 95 on the stop block 83. FIG. 33 shows the assembled depth of drive subassembly, while FIG. 34 is an exploded view. FIG. 35 shows the assembled components, and FIG. 36 is a cross-section view along the section line 36-36 on FIG. 35.

In order to make adjustments to the depth of drive unit 80, the user should depress and hold down the latch pin tab 93. While holding the latch pin down, the user should rotate the adjustment screw 84. A clockwise rotation is for a higher (or "up") setting, which will cause the fastener to penetrate shallower, and a counterclockwise is for a lower (or "down") setting, which will cause the fastener to penetrate deeper. Rotating the adjustment screw 84 causes the adjustable stop block 83 to travel up or down. This up and down travel is in a direction that is transverse to the longitudinal axis of the feed tube, which is substantially perpendicular to that longitudinal axis.

As can be seen on FIG. 36, there is an area at 90 of threaded engagement between the adjustable stop block 83 and the larger thumb wheel/screw 84. When the thumbwheel 84 is turned, its threaded engagement with the stop block 83 will cause that stop block to be displaced, either up or down. This movement affects the depth to which the fastener will be driven by the tool 10. This stop block action is described below in greater detail, in reference to FIG. 37.

Further actions of the depth of drive unit 80 allow the desired fastener setting to be checked by releasing the tab 93 on the latch pin 86. The unit can then be adjusted again, if needed. The locking latch pin 86 is biased upward by a compression spring 87. The top portion of latch pin 86 will lock into one of the slots 94, located on the bottom surface of the head of the adjustment screw 84, and prevents further adjustments. The locking latch pin retainer 88 prevents accidental movement of the adjustable stop block 83.

As noted above, and as can be seen on FIGS. 33 and 34, the adjustable stop block 83 includes an inclined surface 95. As the position of the stop block 83 is moved up or down by action of the adjusting knob 84, the positioning of the tapered face 95 (i.e., the inclined surface) will determine how deep or how high the screw head will be placed into a given substrate of the workpiece. There are matching taper angles on the rear of the nosepiece 32 (at 119) and on the stop block 83 (at the inclined or tapered surface 95). The operation of these surfaces causes the depth of drive setting to be effective.

Figure 37:
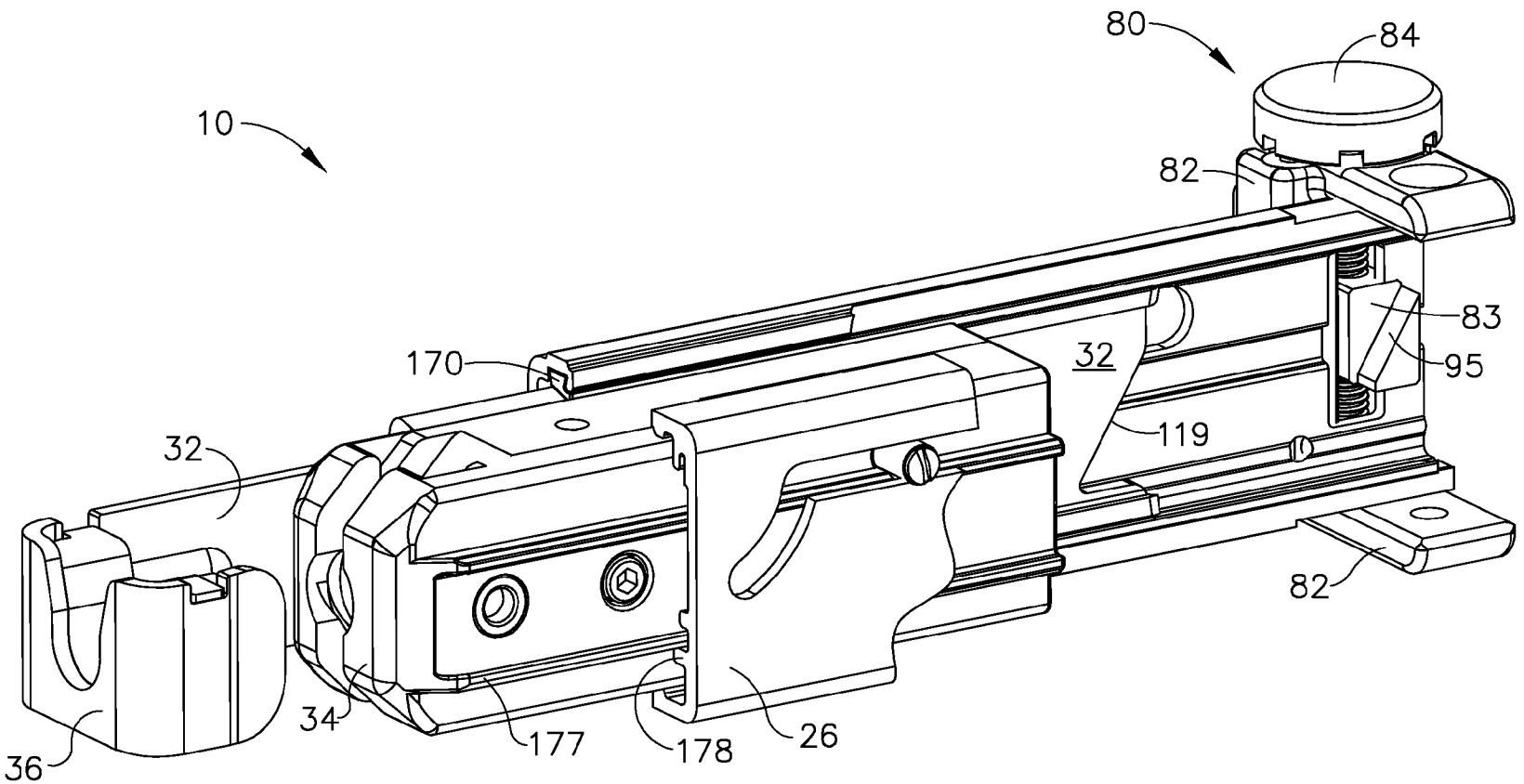
FIG. 37 is a perspective view of the front portion of the tool of FIG. 2, with part of the feed tube housing cut-away, to show the arrangement of the depth of drive subassembly of FIG. 34 and the rear portion of the nosepiece.

Referring now to FIG. 37, some of the major components of the tool 10 are visible, including the nosepiece 32, the sliding block subassembly 34, the feed tube 26, and the depth of drive subassembly 80. The guiding surfaces (i.e., longitudinal protrusions) 177 and 178 of the slide body subassembly and feed tube are visible, as is the end of one of the linear guides 170.

FIG. 37 illustrates the orientation of the inclined surface 95 of the adjustable stop block 83 with respect to the angled rear edge 119 of the nosepiece 32. In this view, the stop block 83 is depicted at about its midpoint position, with respect to its top-most position and its bottom-most position, as it travels along the threaded thumbscrew 84 (see FIG. 36). During a "fastener driving event" (or "fastener driving cycle"), the nosepiece 32 is pushed rearward, which is to the right in FIG. 37, and the rear edge 119 of nosepiece 32 will eventually come into contact with the inclined surface 95 of the stop block 83. When that occurs, the clutch of the motorized driving tool (not shown) will be disengaged, and the drive bit 66 (not shown in this view) will stop turning. Therefore, the position of the stop block 83 becomes the controlling factor as to when the tool stops trying to drive a rotatable fastener (such as a screw), and in effect, acts as a mechanical "depth of drive" controller.

The above action is illustrated on FIGS. 28 and 29. In FIG. 28, the nosepiece 32 is extended, as it has not been actuated. Its rear angled edge 119 is seen to the left (on this view) of the inclined surface 95 of the stop block 83. In FIG. 29, the nosepiece 32 has been actuated all the way to its right-most movement (on this view), and its rear angled edge 119 has made contact with the inclined surface 95 of the stop block 83. Note that in these two views, the stop block 83 has been placed near its bottom-most travel position.

The midpoint position of the stop block 83 that is illustrated on FIG. 37 will cause the rotatable fastener to be driven to a "midpoint depth" of the tool's overall capability. The following example discusses what occurs when the stop block is moved to other positions, from this midpoint location. If the moveable stop block 83 is adjusted all the way to its top-most position, then rear edge 119 will come into contact with inclined surface 95 sooner during the rearward travel of the nosepiece 32 (because the angled edge 119 extends farther to the rear (to the right on FIG. 37) at a higher position along the vertical surface of the nosepiece 32, and the clutch of the motorized tool will be disengaged sooner in its drive cycle. Therefore, the drive bit 66 will not be as far forward when its rotation stops, and thus the rotatable fastener will not be driven as far into the workpiece.

Alternatively, if the moveable stop block 83 is adjusted all the way to its bottom-most position, then rear edge 119 will come into contact with inclined surface 95 later during the rearward travel of the nosepiece 32 (because the angled edge 119 extends less far to the rear (to the right on FIG. 37) at a lower position along the vertical surface of the nosepiece 32, and the clutch of the motorized tool will be disengaged later in its drive cycle. Therefore, the drive bit 66 will be farther forward when its rotation stops, and thus the rotatable fastener will be driven deeper into the workpiece.

Note that, in conventional automatic feed screwdriver systems, the depth of drive adjustable thumb screw typically is located directly inline with the back of the nosepiece, i.e., within the feed housing. Therefore, the overall length of the nosepiece must be shortened to accommodate the added mechanisms. And when using the longest screw length, with the nosepiece set at the longest length, if the feed system is in its home (unactuated) position (i.e., when the nosepiece is fully extended), then more than half (almost three-quarters) of the bearing support between the housing and the back end portion of nosepiece is lost. In addition, virtually all the depth of drive range is lost. The lack of support bearing surface sometimes will cause alignment and stability problems; this is due to premature wear of the linear slide bearings.

The current embodiment takes advantage of this fact by mounting the depth of drive adjusting mechanism assembly on the outside of the housing, thereby maximizing the available bearing ratio in front and rear. The depth of drive subassembly 80 is mounted external to the feed tube housing 22 which allows for an improved bearing ratio between the nosepiece 32 and the feed tube housing. This also allows for a greater insertion distance of the nosepiece into the feed tube housing 22. There is a small opening in the side of the feed tube to allow a portion of the adjustable stop block 83 to extend therethrough; this is the inclined surface 95 portion, which makes contact with the rear edge 119 of the nosepiece along the inner surface of the feed tube. In essence, by moving the depth of drive subassembly 80 outside the feed tube, portions of the slide body and nosepiece subassemblies are able to travel back past the depth of drive components, thus mitigating a length increase on the overall feed system, while providing more bearing surface between the nosepiece and frame while at the extended (at rest) position.

The technology disclosed herein may be used both on attachments for screwdrivers, and with integral automatic fastener driving tools. An example of an attachment embodiment is illustrated on FIG. 1. An example of an integral tool is illustrated on FIG. 38.

Figure 38:
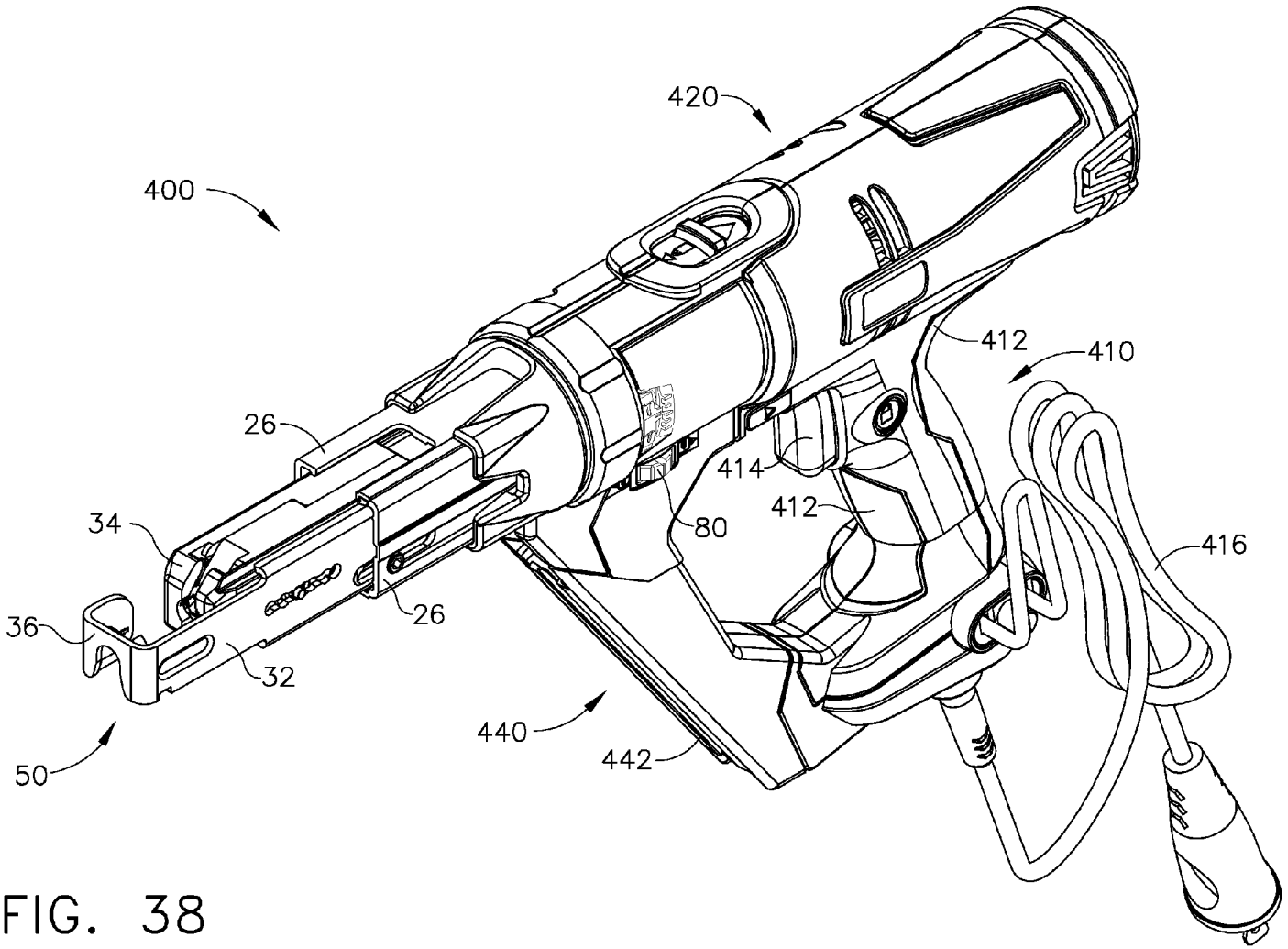
FIG. 38 is a perspective view of the technology disclosed herein as it would be used in an integral automatic screwdriving tool.

Referring now to FIG. 38, an integral automatic fastener driving tool is generally designated by the reference numeral 400. A handle portion 410 includes a set of bottom gripping surfaces 412 that can be used by a person's hand to readily grip the handle and not easily slide along the bottom surface of the housing portion 420. Handle portion 410 also includes a trigger 414, which is used to actuate an electrical switch to operate the internal drive mechanisms of the hand-held portable tool 400. In the illustrated embodiment, a power cord 416 is attached at the bottom area of handle portion 410, which provides electrical power to the internal drive mechanism of the tool 400. Note that some fastener-driving tools have a battery subassembly to provide the electrical power, which of course can be used with the technology disclosed herein.

Handle portion 410 also includes a guide member (or rail) 442 that can receive a flexible collated strip of screws, in this case the collated screw subassembly 60. The collated screw subassembly 60 mainly consists of a plastic strip 62 that has several openings to receive individual screws 64. The overall collated screw subassembly is flexible to a certain degree, as can be seen in FIG. 30 by the curved orientation of the plastic strip 62. The strip 62 (not shown on FIG. 37) is fed through a guide portion, which includes the guide rail 442 and possibly an optional second guide member as a tensioning device (not shown), then up toward the nosepiece 32 and the slide body subassembly 34. The optional second guide member can be added for longer screwdriver tools, if desired; such a design is disclosed in U.S. Pat. No. 7,032,482, titled: TENSIONING DEVICE APPARATUS FOR A BOTTOM FEED SCREW DRIVING TOOL FOR USE WITH COLLATED SCREWS.

It will be understood that the words "screw" and "fastener" are essentially interchangeable, as used herein. The technology disclosed herein is designed to drive rotatable fasteners, which typically are actual screws. However, other types of fasteners, such as bolts, could be used with the tools/attachments of this technical field. A "collated strip of fasteners," as discussed herein, could carry screws or bolts, or some other type of rotatable device; a "collated strip of screws" has essentially the same features and meaning as a "collated strip of fasteners."

Some of the mechanical mechanisms described above for the portable fastener driving tool 400 have been available in the past from Senco Products, Inc. or Senco Brands, Inc., including such tools as the Senco Model Nos. DS162-14V and DS200-14V. These earlier tools utilized a fixed feed tube, a movable slide body 34, and nosepiece 32 structure, without the "extended nose" feature of the technology disclosed herein. Some of the components used in the technology disclosed herein have been disclosed in commonly-assigned patents or patent applications, including a U.S. Pat. No. 5,988,026, titled SCREW FEED AND DRIVER FOR A SCREW DRIVING TOOL; a U.S. Pat. No. 7,032,482, titled TENSIONING DEVICE APPARATUS FOR A BOTTOM FEED SCREW DRIVING TOOL FOR USE WITH COLLATED SCREWS; and a U.S. Pat. No. 7,082,857, titled SLIDING RAIL CONTAINMENT DEVICE FOR FLEXIBLE COLLATED SCREWS USED WITH A TOP FEED SCREW DRIVING TOOL. These patent properties have been assigned to Senco Brands, Inc., and their disclosures are incorporated herein by reference in their entireties.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. An extending mechanism for an automatic fastener driving tool, comprising:

(a) a slide body subassembly comprising:

(i) a drive gear having a first axis of rotation, said drive gear having a first set of engagement extensions along one of its surfaces at a first position along said first axis of rotation, said drive gear having a set of ratchet teeth at a second position along said first axis of rotation;

(ii) a sprocket having a second axis of rotation that is substantially parallel to said first axis of rotation, and that is spaced-apart from said drive gear, said sprocket having a first plurality of spaced-apart protrusions along an outer curved surface at a third position along said second axis of rotation, said sprocket having a second set of engagement extensions at a fourth position along said second axis of rotation;

(iii) a drive belt that runs between said drive gear and said sprocket, said drive belt having a second plurality of spaced-apart protrusions along one of its surfaces, said second plurality of spaced-apart protrusions being in mechanical engagement with said first set of engagement extensions of said drive gear and being in mechanical engagement with said second set of engagement extensions of said sprocket, said drive belt being caused to move if said drive gear rotates, and said drive belt then causing said sprocket to rotate;

(iv) a displacement action mechanism that causes said drive gear to rotate by way of said set of ratchet teeth; and (v) a slide body cover that creates a hollow space and at least partially surrounds said drive gear, said sprocket, said drive belt, and said displacement action mechanism;

(b) a flexible collated strip of fasteners that slides over a surface of said slide body subassembly, said flexible strip having a plurality of spaced-apart openings that engage with said first plurality of spaced-apart protrusions of the sprocket, and are thereby indexed into a drive position by rotation action of said sprocket about said second axis of rotation; and (c) a feed tube with at least one sliding surface, which allows said slide body subassembly to move with respect to said feed tube, which movement actuates said displacement action mechanism;

(d) wherein: said slide body subassembly extends a mechanical motion from said drive gear to said sprocket, all within said hollow space, and thereby allows said first end of the slide body subassembly to reach into smaller spaces.

2. The extending mechanism of claim 1, further comprising: a cam surface in said feed tube, and a camming action mechanism; and wherein:

during movement between said feed tube and said slide body subassembly, said camming action mechanism actuates said displacement action mechanism.

3. The extending mechanism of claim 2, wherein said displacement action mechanism comprises a feed pawl and a detent finger.

4. The extending mechanism of claim 1, wherein said second plurality of spaced-apart protrusions are along an inner surface of said drive belt.

5. The extending mechanism of claim 1, wherein:

(a) said slide body cover exhibits a first cross-section area at a first end that is proximal to said sprocket;

(b) said feed tube has an open space which exhibits a second cross-section area that is larger than said first cross-section area, such that said slide body subassembly fits within said open space of said feed tube; and (c) said larger second cross-section area allows said first end of the slide body subassembly to reach into smaller spaces for driving a fastener into a workpiece.

6. An extending mechanism for an automatic fastener driving tool, comprising:

(a) a slide body subassembly comprising:

(i) a drive gear having a first axis of rotation, said drive gear having a first set of gear teeth along one of its surfaces at a first position along said first axis of rotation, said drive gear having a set of ratchet teeth at a second position along said first axis of rotation;

(ii) a sprocket having a second axis of rotation that is substantially parallel to said first axis of rotation, and that is spaced-apart from said drive gear, said sprocket having a plurality of spaced-apart protrusions along an outer curved surface at a third position along said second axis of rotation, said sprocket having a second set of gear teeth along one of its surfaces at a fourth position along said second axis of rotation;

(iii) at least one intermediate gear having at least one intermediate axis of rotation, said at least one intermediate gear having at least one third set of gear teeth that are in mechanical engagement with said first set of gear teeth of said drive gear and being in mechanical engagement with said second set of gear teeth of said sprocket, said at least one intermediate gear being caused to move if said drive gear rotates, and said at least one intermediate gear then causing said sprocket to rotate;

(iv) a displacement action mechanism that causes said drive gear to rotate by way of said set of ratchet teeth; and (v) a slide body cover that creates a hollow space and at least partially surrounds said drive gear, said sprocket, said at least one intermediate gear, and said displacement action mechanism;

(b) a flexible collated strip of fasteners that slides over a surface of said slide body subassembly, said flexible strip having a plurality of spaced-apart openings that engage with said plurality of spaced-apart protrusions of the sprocket, and are thereby indexed into a drive position by rotation action of said sprocket about said second axis of rotation; and (c) a feed tube with at least one sliding surface, which allows said slide body subassembly to move with respect to said feed tube, which movement actuates said displacement action mechanism;

(d) wherein: said slide body subassembly extends a mechanical motion from said drive gear to said sprocket, all within said hollow space, and thereby allows said first end of the slide body subassembly to reach into smaller spaces.

7. The extending mechanism of claim 6, further comprising: a cam surface in said feed tube, and a camming action mechanism; and wherein:

during movement between said feed tube and said slide body subassembly, said camming action mechanism actuates said displacement action mechanism.

8. The extending mechanism of claim 7, wherein said displacement action mechanism comprises a feed pawl and a detent finger.

9. The extending mechanism of claim 6, wherein:

(a) said slide body cover exhibits a first cross-section area at a first end that is proximal to said sprocket;

(b) said feed tube has an open space which exhibits a second cross-section area that is larger than said first cross-section area, such that said slide body subassembly fits within said open space of said feed tube; and (c) said larger second cross-section area allows said first end of the slide body subassembly to reach into smaller spaces for driving a fastener into a workpiece.

10. An extending mechanism for an automatic fastener driving tool, comprising:

(a) a slide body subassembly comprising:

(i) a drive gear having a first axis of rotation, said drive gear having a first set of engagement extensions along one of its surfaces at a first position along said first axis of rotation, said drive gear having a set of ratchet teeth at a second position along said first axis of rotation;

(ii) a sprocket having a second axis of rotation that is substantially parallel to said first axis of rotation, and that is spaced-apart from said drive gear, said sprocket having a first plurality of spaced-apart protrusions along an outer curved surface at a third position along said second axis of rotation, said sprocket having a second set of engagement extensions at a fourth position along said second axis of rotation;

(iii) a drive belt that runs between said drive gear and said sprocket, said drive belt having a second plurality of spaced-apart protrusions along one of its surfaces, said second plurality of spaced-apart protrusions being in mechanical engagement with said first set of engagement extensions of said drive gear and being in mechanical engagement with said second set of engagement extensions of said sprocket, said drive belt being caused to move if said drive gear rotates, and said drive belt then causing said sprocket to rotate;

(iv) a displacement action mechanism that causes said drive gear to rotate by way of said set of ratchet teeth; and (v) a slide body cover that creates a hollow space and at least partially surrounds said drive gear, said sprocket, said drive belt, and said displacement action mechanism;

(b) a flexible collated strip of fasteners that slides over a surface of said slide body subassembly, said flexible strip having a plurality of spaced-apart openings that engage with said first plurality of spaced-apart protrusions of the sprocket, and are thereby indexed into a drive position by rotation action of said sprocket about said second axis of rotation; and (c) a feed tube with at least one sliding surface, which allows said slide body subassembly to move with respect to said feed tube, which movement actuates said displacement action mechanism;

(d) wherein: said slide body subassembly extends a mechanical motion from said drive gear to said sprocket, all within said hollow space, and thereby allows said first end of the slide body subassembly to reach farther from said feed tube.

11. The extending mechanism of claim 10, further comprising: a cam surface in said feed tube, and a camming action mechanism; and wherein:

during movement between said feed tube and said slide body subassembly, said camming action mechanism actuates said displacement action mechanism.

12. The extending mechanism of claim 11, wherein said displacement action mechanism comprises a feed pawl and a detent finger.

13. The extending mechanism of claim 10, wherein said second plurality of spaced-apart protrusions are along an inner surface of said drive belt.

14. The extending mechanism of claim 10, wherein:

(a) said slide body cover exhibits a first cross-section area at a first end that is proximal to said sprocket;

(b) said feed tube has an open space which exhibits a second cross-section area that is larger than said first cross-section area, such that said slide body subassembly fits within said open space of said feed tube; and (c) said larger second cross-section area allows said first end of the slide body subassembly to reach into smaller spaces for driving a fastener into a workpiece.

15. An extending mechanism for an automatic fastener driving tool, comprising:

(a) a slide body subassembly comprising:

(i) a drive gear having a first axis of rotation, said drive gear having a first set of gear teeth along one of its surfaces at a first position along said first axis of rotation, said drive gear having a set of ratchet teeth at a second position along said first axis of rotation;

(ii) a sprocket having a second axis of rotation that is substantially parallel to said first axis of rotation, and that is spaced-apart from said drive gear, said sprocket having a plurality of spaced-apart protrusions along an outer curved surface at a third position along said second axis of rotation, said sprocket having a second set of gear teeth along one of its surfaces at a fourth position along said second axis of rotation;

(iii) at least one intermediate gear having at least one intermediate axis of rotation, said at least one intermediate gear having at least one third set of gear teeth that are in mechanical engagement with said first set of gear teeth of said drive gear and being in mechanical engagement with said second set of gear teeth of said sprocket, said at least one intermediate gear being caused to move if said drive gear rotates, and said at least one intermediate gear then causing said sprocket to rotate;

(iv) a displacement action mechanism that causes said drive gear to rotate by way of said set of ratchet teeth; and (v) a slide body cover that creates a hollow space and at least partially surrounds said drive gear, said sprocket, said at least one intermediate gear, and said displacement action mechanism;

(b) a flexible collated strip of fasteners that slides over a surface of said slide body subassembly, said flexible strip having a plurality of spaced-apart openings that engage with said plurality of spaced-apart protrusions of the sprocket, and are thereby indexed into a drive position by rotation action of said sprocket about said second axis of rotation; and (c) a feed tube with at least one sliding surface, which allows said slide body subassembly to move with respect to said feed tube, which movement actuates said displacement action mechanism;

(d) wherein: said slide body subassembly extends a mechanical motion from said drive gear to said sprocket, all within said hollow space, and thereby allows said first end of the slide body subassembly to reach farther from said feed tube.

16. The extending mechanism of claim 15, further comprising: a cam surface in said feed tube, and a camming action mechanism; and wherein:

during movement between said feed tube and said slide body subassembly, said camming action mechanism actuates said displacement action mechanism.

17. The extending mechanism of claim 15, wherein said displacement action mechanism comprises a feed pawl and a detent finger.

18. The extending mechanism of claim 15, wherein:

(a) said slide body cover exhibits a first cross-section area at a first end that is proximal to said sprocket;

(b) said feed tube has an open space which exhibits a second cross-section area that is larger than said first cross-section area, such that said slide body subassembly fits within said open space of said feed tube; and (c) said larger second cross-section area allows said first end of the slide body subassembly to reach into smaller spaces for driving a fastener into a workpiece.

* * * * *